US008857957B2

(12) United States Patent
Ishizawa et al.

(10) Patent No.: US 8,857,957 B2
(45) Date of Patent: Oct. 14, 2014

(54) LIQUID CONTAINER AND METHOD OF MANUFACTURING LIQUID CONTAINER

(71) Applicant: Seiko Epson Corporation, Tokyo (JP)

(72) Inventors: Taku Ishizawa, Nagano-ken (JP); Hiroyuki Kawate, Yamanashi-ken (JP); Hiroshi Nose, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/014,850

(22) Filed: Aug. 30, 2013

(65) Prior Publication Data

US 2014/0061200 A1 Mar. 6, 2014

(30) Foreign Application Priority Data

Aug. 31, 2012 (JP) ..... 2012-191474
Sep. 27, 2012 (JP) ..... 2012-213719

(51) Int. Cl.
*B41J 2/175* (2006.01)
*B41J 29/393* (2006.01)

(52) U.S. Cl.
CPC ..... *B41J 2/17559* (2013.01); *B41J 2/17513* (2013.01)
USPC ..... 347/86; 347/19

(58) Field of Classification Search
CPC .. B41J 2/1752; B41J 2/17509; B41J 2/17513; B41J 2/17523; B41J 2002/1728; B41J 29/02; B41J 2/17559
USPC ..... 347/19, 85, 86, 87
See application file for complete search history.

(56) References Cited

U.S. PATENT DOCUMENTS

| | | | | |
|---|---|---|---|---|
| 6,848,776 | B2 * | 2/2005 | Nishioka et al. | 347/86 |
| 7,699,453 | B2 * | 4/2010 | Ishizawa et al. | 347/86 |
| 7,775,650 | B2 * | 8/2010 | Ishizawa et al. | 347/86 |
| 8,066,361 | B2 * | 11/2011 | Miyajima et al. | 347/86 |
| 2008/0036833 | A1 | 2/2008 | Shinada et al. | |
| 2009/0237473 | A1 | 9/2009 | Miyajima et al. | |
| 2009/0322832 | A1 | 12/2009 | Wanibe et al. | |
| 2009/0322838 | A1 | 12/2009 | Wanibe et al. | |
| 2009/0322839 | A1 | 12/2009 | Ishizawa et al. | |
| 2010/0073438 | A1 | 3/2010 | Wanibe et al. | |

FOREIGN PATENT DOCUMENTS

| | | |
|---|---|---|
| JP | 2009-226687 | 10/2009 |
| JP | 2009-298159 | 12/2009 |
| JP | 2010-005958 | 1/2010 |

* cited by examiner

*Primary Examiner* — Anh T. N. Vo

(57) ABSTRACT

A method of manufacturing a liquid container. The liquid container includes a container portion, a supply opening through which the liquid inside the container portion is supplied outside of the liquid container, and a detection member for detecting an amount of the liquid in the container portion. The container portion is partitioned into a first, second, third, and fourth chambers, which are downstream from each other in this order with respect to flow of the liquid from the container portion toward the supply opening. The fourth container chamber is inside the third container chamber, but partitioned from the third container chamber by a first sheet member. The detection member is inside the fourth container chamber. The method includes forming an injection opening in communication with the container portion at the fourth container chamber or downstream from the fourth container chamber and injecting liquid into the injection opening.

18 Claims, 17 Drawing Sheets

LIQUID CONTAINER AND METHOD OF MANUFACTURING LIQUID CONTAINER

CROSS-REFERENCE TO RELATED APPLICATIONS

This application claims priority to Japanese Patent Application No. 2012-191474 filed on Aug. 31, 2012, and Japanese Patent Application No. 2012-213719 filed on Sep. 27, 2012. The entire disclosures of Japanese Patent Application Nos. 2012-191474 and 2012-213719 are hereby incorporated herein by reference.

BACKGROUND

1. Technical Field

The present invention relates to a liquid container manufacturing method, a liquid container, and the like.

2. Related Art

In the related art, a technique is known of using an ink cartridge (alternatively referred to as simply a "cartridge") as a technique for supplying ink to a printer, which is an exemplary liquid-jet apparatus. When a cartridge is manufactured, ink is injected into the internal portion of the cartridge. The cartridge is attached to a printer, and ink inside the cartridge flows through a supply opening to the printer. In the related art, when ink is consumed until little or no ink remains in a cartridge, the cartridge is replaced with a new cartridge. Alternatively, after a cartridge is used up, it may be recycled by again injecting ink into the cartridge. The related art cartridge may include a detection member (e.g., a piezoelectric element or a prism, also referred to as a first member) that can be used to detect the ink residual state (i.e., whether or not ink remains or how much ink remains). (Refer to, for example, JP-A-2010-5958.).

Incidentally, in order to increase the amount of ink in a cartridge, it is conceivable to increase the capacity of a container portion that contains ink in the cartridge. An exemplary method of increasing the capacity of the container portion is to increase the area of the container portion in directions that, with respect to the orientation in which the cartridge is used, intersect the vertical direction. This can avoid an increase in the size of the cartridge in the vertical direction. However, when the area of the container portion is increased in directions that intersect the vertical direction, the detection precision in detecting the ink residual amount tends to decrease. The reason for this is that, even though the residual amount of ink is the same, the height of the ink surface in a larger-volume cartridge will be lower than in a smaller-volume cartridge.

In order to address this problem, it is conceivable to partition off a small chamber having a volume smaller than that of the container portion, and to provide a detection member in the small chamber. With such a small chamber, even when little ink remains it easier to keep the liquid surface high in the small chamber. Thus, a decrease in the detection precision in detecting the ink residual amount can be avoided. As a method of injecting ink into the thus configured cartridge, a method in which ink is injected at a location other than the small chamber may be employed. However, when using the method in which ink is injected from a location other than the small chamber, it is difficult to distribute a sufficient amount of ink to the small chamber. As a result, there is a problem in that the detection precision in detecting the ink residual amount tends to drop. This sort of problem occurs not only in a cartridge that internally contains ink, but also in other liquid containers that contain liquid other than ink.

SUMMARY

An advantage of some aspects of the invention can be achieved in the following modes or application examples.

Application Example 1 is directed to a method of manufacturing a liquid container as follows. The liquid container includes a casing provided with a container portion containing liquid, a supply opening through which the liquid inside the container portion is supplied to the outside, and a detection member for detecting an amount of the liquid inside the container portion. The container portion in the casing is divided into a first container chamber containing the liquid, a second container chamber provided downstream of the first container chamber with respect to a flow of the liquid from the container portion toward the supply opening, and in communication with the first container chamber, a third container chamber provided downstream of the second container chamber and in communication with the second container chamber, and a fourth container chamber provided downstream of the third container chamber and in communication with the third container chamber. The fourth container chamber is provided inside the third container chamber and is partitioned by a first sheet member from the third container chamber. The detection member is provided inside the fourth container chamber. In this liquid container, an injection opening in communication with the container portion is formed at the fourth container chamber or on the side downstream of the fourth container chamber, and liquid is injected from the injection opening.

According to this application example, the liquid is injected into the container portion from an injection opening that is formed at the fourth container chamber provided with the detection member or on the side downstream of the fourth container chamber. Thus, the injected liquid is easily introduced into the fourth container chamber. Thus, a decrease in the precision in detecting the amount of liquid can be more readily avoided.

Application Example 2 is directed to the method of manufacturing a liquid container as follows. The injection opening is formed at the fourth container chamber.

According to this application example, the liquid can be directly injected into the fourth container chamber. Thus, the injected liquid is easily introduced into the fourth container chamber.

Application Example 3 is directed to the method of manufacturing a liquid container as follows. In the casing, a channel from the third container chamber to the fourth container chamber includes a first outer wall channel that is provided on a second outer wall of the casing, and the first outer wall channel is sealed by a third sheet member from the outside of the casing. Furthermore, the injection opening is formed from the second outer wall side through a region of the third sheet member in which the third sheet member overlaps a communication opening that is open from the first outer wall channel toward an internal space of the fourth container chamber.

According to this application example, the liquid can be directly injected into the fourth container chamber. Thus, the injected liquid is easily introduced into the fourth container chamber.

Application Example 4 is directed to the method of manufacturing a liquid container as follows. A first outer wall of the casing is provided with an opening portion that is open from the outside of the casing toward an internal space of the fourth container chamber. The detection member is light-transmissive and projects from the opening portion into the fourth container chamber in a state in which the detection member covers the opening portion from the outside of the casing. Furthermore, the injection opening is formed at the detection member.

According to this application example, the liquid can be directly injected into the fourth container chamber. Thus, the injected liquid is easily introduced into the fourth container chamber.

Application Example 5 is directed to the method of manufacturing a liquid container as follows. A first outer wall of the casing is provided with an opening portion that is open from the outside of the casing toward an internal space of the fourth container chamber. The detection member is light-transmissive and projects from the opening portion into the fourth container chamber in a state in which the detection member covers the opening portion from the outside of the casing. The injection opening is formed by detaching the detection member from the casing, thereby exposing the opening portion, and the liquid is injected from the opening portion functioning as the injection opening.

According to this application example, the liquid can be directly injected into the fourth container chamber. Thus, the injected liquid is easily introduced into the fourth container chamber.

Application Example 6 is directed to the method of manufacturing a liquid container as follows. In the casing, a valve that allows the liquid to flow from the fourth container chamber toward the supply opening and that blocks flow of the liquid from the supply opening toward the fourth container chamber is provided between the fourth container chamber and the supply opening. Furthermore, the injection opening is formed at a channel from the fourth container chamber to the valve.

According to this application example, the liquid can be injected from the channel downstream of the fourth container chamber. Thus, the liquid flows through the channel downstream of the fourth container chamber and reaches the fourth container chamber. If air bubbles are mixed in with the injected liquid, the air bubbles are more readily caught in the channel while the liquid is flowing through the channel. Accordingly, mixing of air bubbles in the ink in the fourth container chamber can be more readily avoided. As a result, attachment of air bubbles to the detection member can be more readily suppressed, and, thus, it is easier to avoid a decrease in the precision in detecting the amount of liquid.

Application Example 7 is directed to the method of manufacturing a liquid container as follows. The channel from the fourth container chamber to the valve includes a second outer wall channel that is provided on a second outer wall of the casing, and the second outer wall channel is sealed by a third sheet member from the outside of the casing. Furthermore, the injection opening is formed through the third sheet member in the second outer wall channel.

According to this application example, the injection opening is formed through the third sheet member. Thus, formation of the injection opening through the casing can be avoided.

Application Example 8 is directed to the method of manufacturing a liquid container as follows. A first outer wall of the casing is provided with an opening portion that is open from the outside of the casing toward an internal space of the fourth container chamber. The detection member is light-transmissive and projects from the opening portion into the fourth container chamber in a state in which the detection member covers the opening portion from the outside of the casing. The channel from the fourth container chamber to the valve includes a third outer wall channel that is provided on the first outer wall of the casing, and the third outer wall channel is sealed from the outside of the casing by a second sheet member that is light-transmissive. Furthermore, the injection opening is formed through the second sheet member in the third outer wall channel.

According to this application example, the liquid can be injected from the first outer wall side provided with the light-transmissive detection member, through the third outer wall channel, into the container portion. Accordingly, the state of the liquid being injected can be seen through the detection member when the liquid is injected.

Application Example 9 is directed to the method of manufacturing a liquid container as follows. The channel from the fourth container chamber to the valve is provided with a bent portion, and at least part of a channel from the bent portion to the valve overlaps the valve. Furthermore, the injection opening is formed at a location in which the channel from the bent portion to the valve overlaps the valve.

According to this application example, at least part of the liquid injected from the injection opening flows through the bent portion and reaches the fourth container chamber. If air bubbles are mixed in with the injected liquid, the air bubbles are more readily caught in the bent portion while the liquid is flowing through the bent portion. Accordingly, it is easier to avoid mixing of air bubbles in the ink in the fourth container chamber.

Application Example 10 is directed to a liquid container manufactured using the above-described method of manufacturing a liquid container.

According to the liquid container of this application example is manufactured using a manufacturing method that can easily introduce the injected liquid into the fourth container chamber. Thus, with this liquid container, a decrease in the precision in detecting the amount of liquid can be more readily avoided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
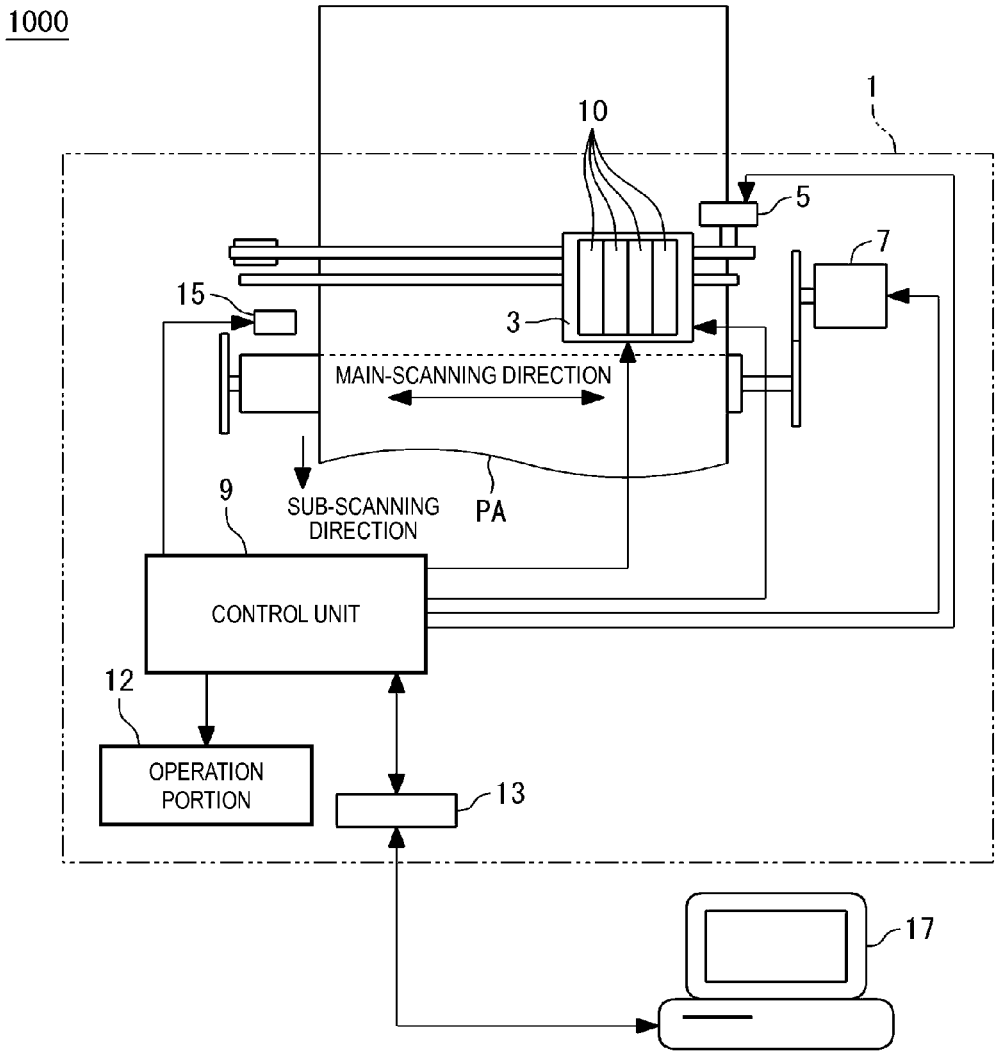
FIG. 1 is a diagram showing the schematic configuration of a liquid-jet system in this embodiment.

Hereinafter, using a liquid-jet system as an example, embodiments will be described with reference to the drawings. Note that, in the drawings, the constituent components and members may be shown in different scales, so that each constituent component is large enough to be recognized.

Configuration of the Liquid-Jet System

As shown in FIG. 1, a liquid-jet system 1000 has a printer 1 that is an exemplary liquid-jet apparatus, and cartridges 10 that are exemplary liquid containers containing ink as liquid. The printer 1 is an ink-jet printing apparatus that prints on a printing paper PA by ejecting ink from a print head toward the printing paper PA. The printer 1 has a holder 3, a first motor 5, a second motor 7, a control unit 9, an operation portion 12, an interface 13, and a detecting device 15.

The holder 3 is provided with a print head (not shown) for ejecting ink, at a side thereof opposing the printing paper PA. The cartridges 10 are detachably mounted in the holder 3. Each cartridge 10 contains a different colored ink, such as cyan, magenta, and yellow. Ink contained in the cartridges 10 is supplied to the print head of the holder 3, and is ejected onto the printing paper PA.

The first motor 5 drives the holder 3 in the main-scanning direction. The second motor 7 transports the printing paper PA in the sub-scanning direction. The control unit 9 controls the overall operation of the printer 1. The detecting device 15 is provided in the printer 1, and optically detects the residual amount of ink in the cartridges 10. In this embodiment, as a method of detecting the ink residual amount, a method is employed in which the detecting device 15 detects whether or not the residual amount of ink in the cartridges 10 becomes lower than a predetermined amount.

The control unit 9 controls the first motor 5, the second motor 7, and the print head to print based on print data that has been received from a computer 17 or the like, connected via the predetermined interface 13. The control unit 9 determines the ink residual state (i.e., how much ink remains or whether or not ink remains) in the cartridges 10, based on a result received from the detecting device 15. The operation portion 12 is connected to the control unit 9, and accepts various operations from a user.

Configuration of the Cartridges

Figure 2A:
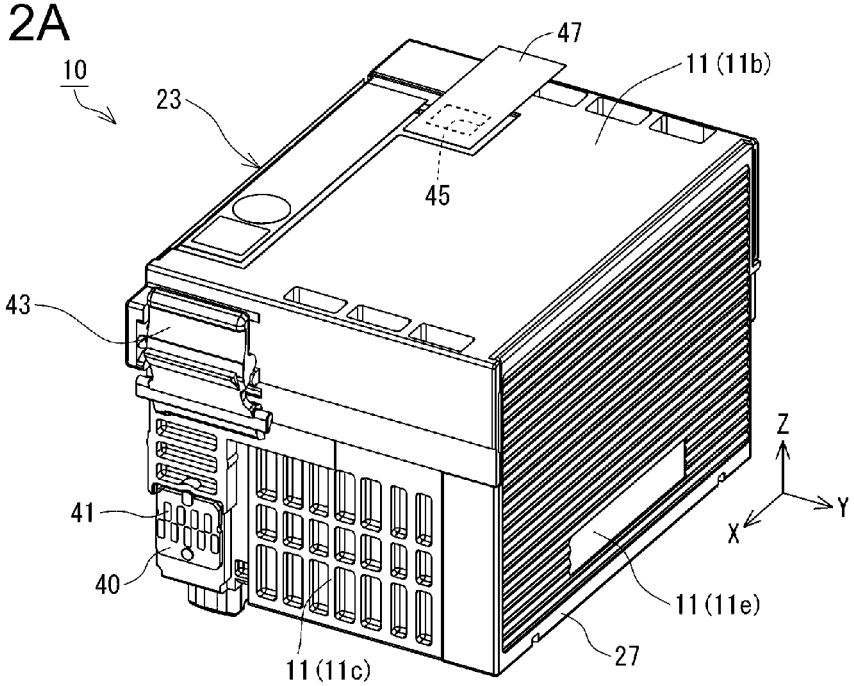
FIGS. 2A and 2B are perspective views showing the external appearance of a cartridge in this embodiment.
Figure 2B:
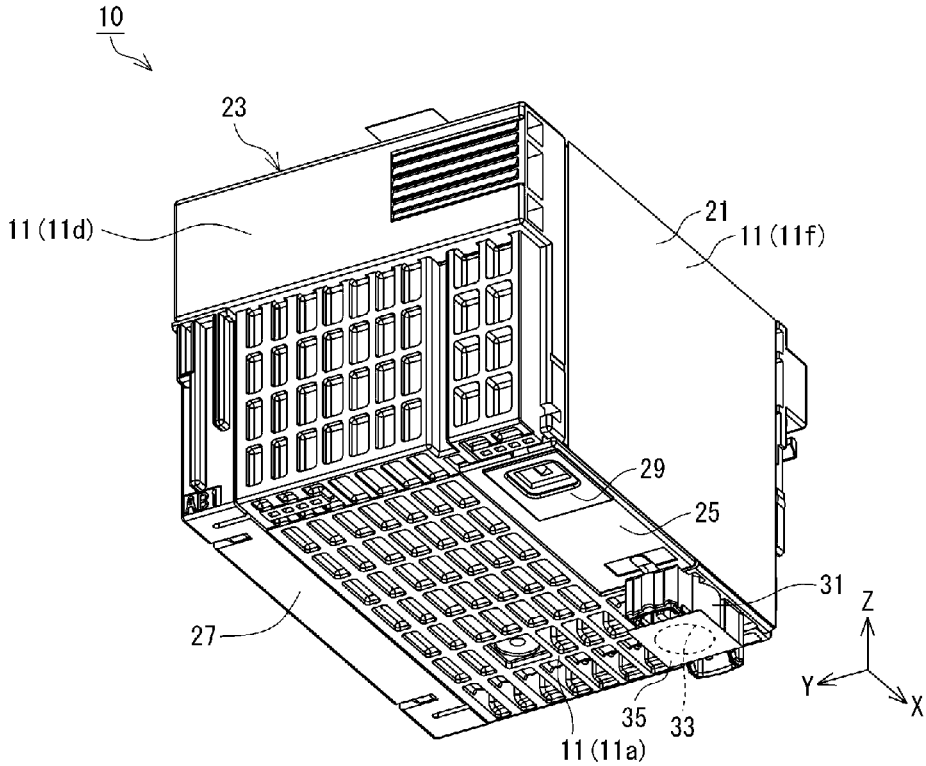

The cartridges 10 are each substantially in the shape of a rectangular parallelepiped, as shown in FIG. 2A, which is a first external perspective view of one of the cartridges 10, and in FIG. 2B, which is a second external perspective view of the cartridge 10. FIGS. 2A and 2B show the XYZ axes, which are coordinate axes orthogonal to each other. The XYZ axes are indicated as necessary in subsequent drawings as well. While the printer 1 is disposed on a horizontal plane and the cartridge 10 is mounted in the printer (i.e., the cartridge 10 is in its mounted orientation), the negative direction of the Z axis matches the vertically-downward direction. Also, the horizontal plane is a plane that is parallel to the X axis direction and the Y axis direction.

The outer surface (outer shell) of the cartridge 10 includes six faces 11. Hereinafter, when identifying each of the six faces 11, the six faces 11 are respectively referred to as a bottom face 11*a*, a top face 11*b*, a front face 11*c*, a rear face 11*d*, a right face 11*e*, and a left face 11*f*. The six faces 11 can be considered also as an outer shell member forming the outer shell of the cartridge 10. Each face 11 is planar. The term "planar" here encompasses a face whose entire area is completely flat, and faces that are partially uneven. That is to say, a face may be partially uneven to some extent. The external appearance of each face 11 is substantially rectangular in plan view. The outer surface (exterior surface) of the cartridge 10 includes a film 21 forming part of the left face 11*f*, a casing 23, a cover 25, and a cover 27 forming the right face 11*e*.

The bottom face 11*a* is a general concept that encompasses a wall forming the bottom wall of the cartridge 10, with respect to the mounted orientation of the cartridge 10, and may also be referred to as a "bottom face wall portion (bottom wall)". The top face 11*b* is a general concept that encompasses a wall forming the top wall of the cartridge 10, with respect to the mounted orientation of the cartridge 10, and may also be referred to as a "top face wall portion (top wall)". The front face 11*c* is a general concept that encompasses a wall forming the front face wall of the cartridge 10 with respect to the mounted orientation of the cartridge 10, and may also be referred to as a "front face wall portion (front face wall)". The rear face 11*d* is a general concept that encompasses a wall forming the rear face wall with respect to the mounted orientation of the cartridge 10, and may also be referred to as a "rear face wall portion (rear face wall)". The right face 11*e* is a concept that encompasses a wall forming the right wall with respect to the mounted orientation of the cartridge 10, and may also be referred to as a "right face wall portion (right face wall)". The left face 11*f* is a general concept that encompasses a wall forming the left wall with respect to the mounted orientation of the cartridge 10, and may also be referred to as a "left face wall portion (left face wall)". Note that a "wall portion" or a "wall" need not be configured from a single wall, but may be configured from a plurality of walls. For example, the bottom face wall portion (the bottom face 11*a*) is the wall positioned on the negative direction side of the Z axis from the internal space of the cartridge 10, with respect to the mounted orientation of the cartridge 10. In other words, as shown in FIG. 2B, the bottom face wall portion (the bottom face 11*a*) is configured by the cover 25, the casing 23, a detection member 29 (described later), and the like.

The bottom face 11*a* and the top face 11*b* oppose each other, and are separated from each other, in the Z axis direction. The front face 11*c* and the rear face 11*d* oppose each other, and are separated from each other, in the X axis direction. The right face 11*e* and the left face 11*f* oppose each other, and are separated from each other, in the Y axis direction. The length (the size in the X axis direction) is the largest dimension of the cartridge 10, followed by the width (the size in the Y axis direction) and the height (the size in the Z axis direction) in this order. Note that the relationship in size between the length, the width, and the height of the cartridge 10 can be freely changed. For example, the descending order in size may be the height, the length, and then the width. Alternatively, the height, the length, and the width may be the same size.

As shown in FIG. 2B, the bottom face 11*a* is provided with a supply portion 31. The supply portion 31 projects from the bottom face 11*a* in the negative direction of the Z axis. The supply portion 31 has a generally cylindrical shape. The bottom face 11*a* is a horizontal face with respect to the mounted orientation of the cartridge 10. A liquid supply needle provided in the holder 3, for supplying ink to the print head, is inserted into the supply portion 31. A supply opening 33 for supplying ink from inside the cartridge 10 to outside of the cartridge 10 is formed at the end face of the supply portion 31. The liquid supply needle is inserted into the supply opening 33, to connect the cartridge 10 to the holder 3. Before the cartridge 10 is mounted to the printer 1, the supply opening 33 is closed by a film 35. The film 35 is configured such that it is punctured by the liquid supply needle.

The bottom face 11*a* is provided with the detection member 29. In this embodiment, the detection member 29 is provided at a position that is closer to the rear face 11*d* than to the front face 11*c*. In other words, the detection member 29 is provided closer to the rear face 11*d* than is the position at which the supply portion 31 is provided on the bottom face 11*a*. The detection member 29 is used in the process to detect the liquid residual state in the cartridge 10 by the detecting device 15. The detection member 29 is transparent, and covers from the outside an opening portion (described later) in the bottom face 11*a* of the casing 23. The opening portion in the bottom face 11*a* of the casing 23 is in communication with a container portion (described later) that contains ink. In this embodiment, the container chamber can be seen through the detection member 29. Note that the detection member 29 may be translucent.

As shown in FIGS. 2A and 2B, the front face 11*c* intersects the bottom face 11*a*. The front face 11*c* also intersects the top face 11*b*. On the front face 11*c*, a circuit board 40 is provided at a position that is closer to the bottom face 11*a* than to the top face 11*b*. A plurality of terminals 41 are formed on the surface of the circuit board 40. In the mounted orientation of the cartridge 10, the plurality of terminals 41 are respectively in contact with corresponding terminals of a plurality of apparatus terminals that are provided on the holder 3. Accordingly, the circuit board 40 is electrically connected to the control unit 9 of the printer 1. A rewritable memory is provided on the back face of the circuit board 40. The memory stores information relating to the cartridge 10, such as the ink consumption amount, the ink color, and the like of the cartridge 10. A lever 43 is provided on the front face 11*c* at a position that is closer to the top face 11*b* than is the circuit board 40. The lever 43 elastically deforms when used to attach and detach the cartridge 10 to and from the printer 1.

As shown in FIG. 2A, an atmospheric opening port 45 is formed in the top face 11*b*. The atmospheric opening port 45 is an opening for introducing air into the cartridge 10. A film 47 for sealing the atmospheric opening port 45 is attached to the cartridge 10 that has been filled with ink, but not yet used. When the cartridge 10 is used, a user peels away the film 47 and then attaches the cartridge 10 to the holder 3.

Note that the directions of the cartridge 10 can be prescribed as below using the XYZ axes, which are coordinate axes orthogonal to each other. The direction in which the bottom face 11*a* and the top face 11*b* oppose each other matches the Z axis direction. In the Z axis direction, the direction from the bottom face 11*a* to the top face 11*b* is the positive direction of the Z axis. In the Z axis direction, the direction from the top face 11*b* to the bottom face 11*a* is the negative direction of the Z axis. Also, the direction in which the front face 11*c* and the rear face 11*d* oppose each other matches the X axis direction. In the X axis direction, the direction from the rear face 11*d* to the front face 11*c* is the positive direction of the X axis. In the X axis direction, the direction from the front face 11*c* to the rear face 11*d* is the negative direction of the X axis. Also, the direction in which the right face 11*e* and the left face 11*f* oppose each other matches the Y axis direction. In the Y axis direction, the direction from the left face 11*f* to the right face 11*e* is the positive direction of the Y axis. In the Y axis direction, the direction from the right face 11*e* to the left face 11*f* is the negative direction of the Y axis.

The directions of the cartridge 10 can be prescribed as below using the XYZ axes, which are coordinate axes orthogonal to each other. The direction in which the supply portion 31 extends from the bottom face 11*a* matches the Z axis direction. In the Z axis direction, the direction from the upstream to the downstream in the fluid flow is the negative direction of the Z axis. In the Z axis direction, the direction from the downstream to the upstream in the fluid flow is the positive direction of the Z axis. Also, it can be said that the movement direction of the cartridge 10 when being attached to or detached from the holder 3 matches the Z axis direction. In the Z axis direction, the movement direction of the cartridge 10 when being attached to the holder 3 is the negative direction of the Z axis. In the Z axis direction, the movement direction of the cartridge 10 when being detached from the holder 3 is the positive direction of the Z axis. Also, the direction that the cartridge 10 mounted on the holder 3 moves in the main-scanning direction under the drive of the first motor 5 (FIG. 1) is the Y axis direction. Also, it can be said that the length direction of the cartridge 10 is the X axis direction, the width direction is the Y axis direction, and the height direction is the Z axis direction.

Figure 3:
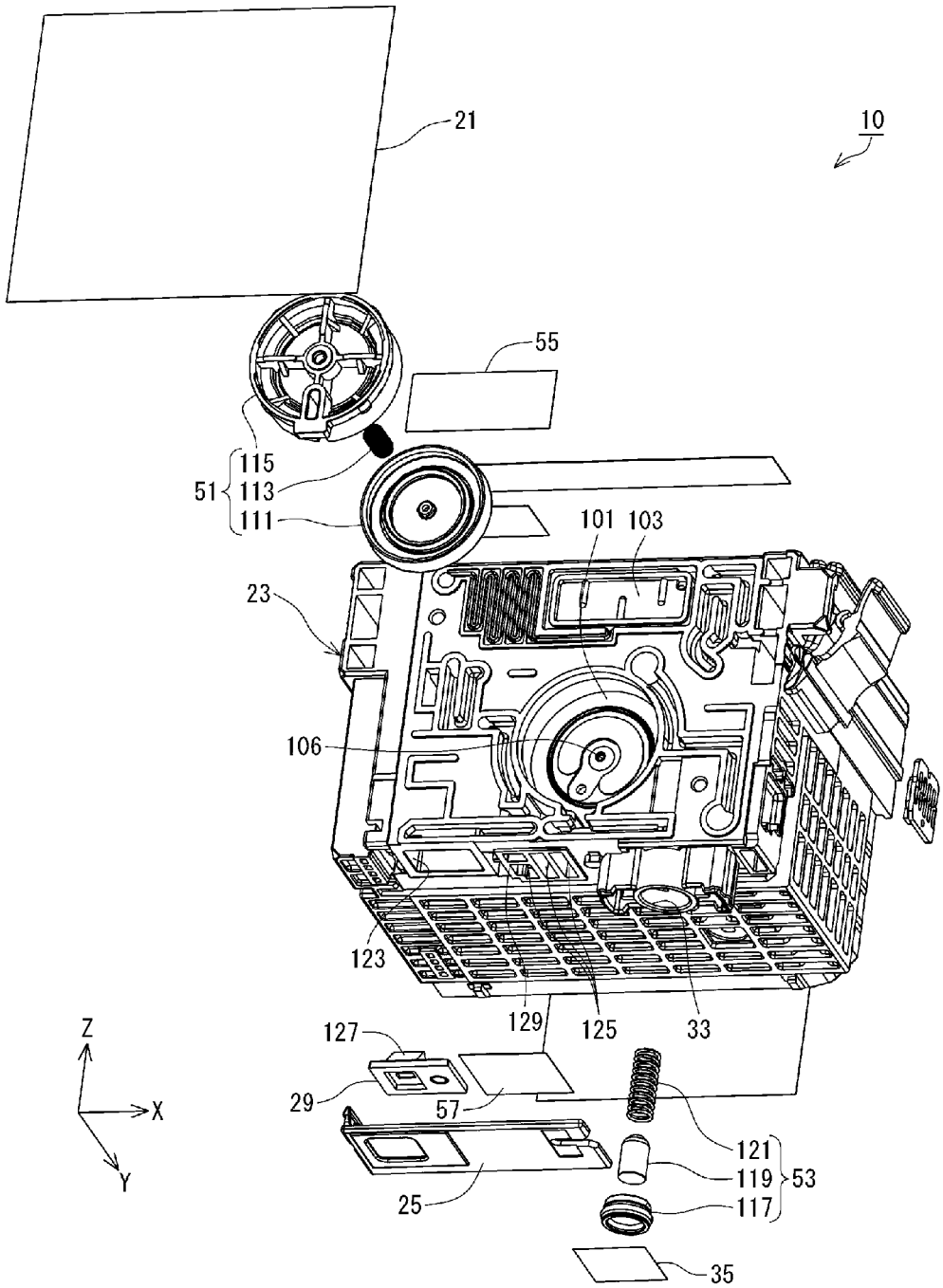
FIG. 3 is an exploded perspective view of the cartridge in this embodiment.
Figure 4:
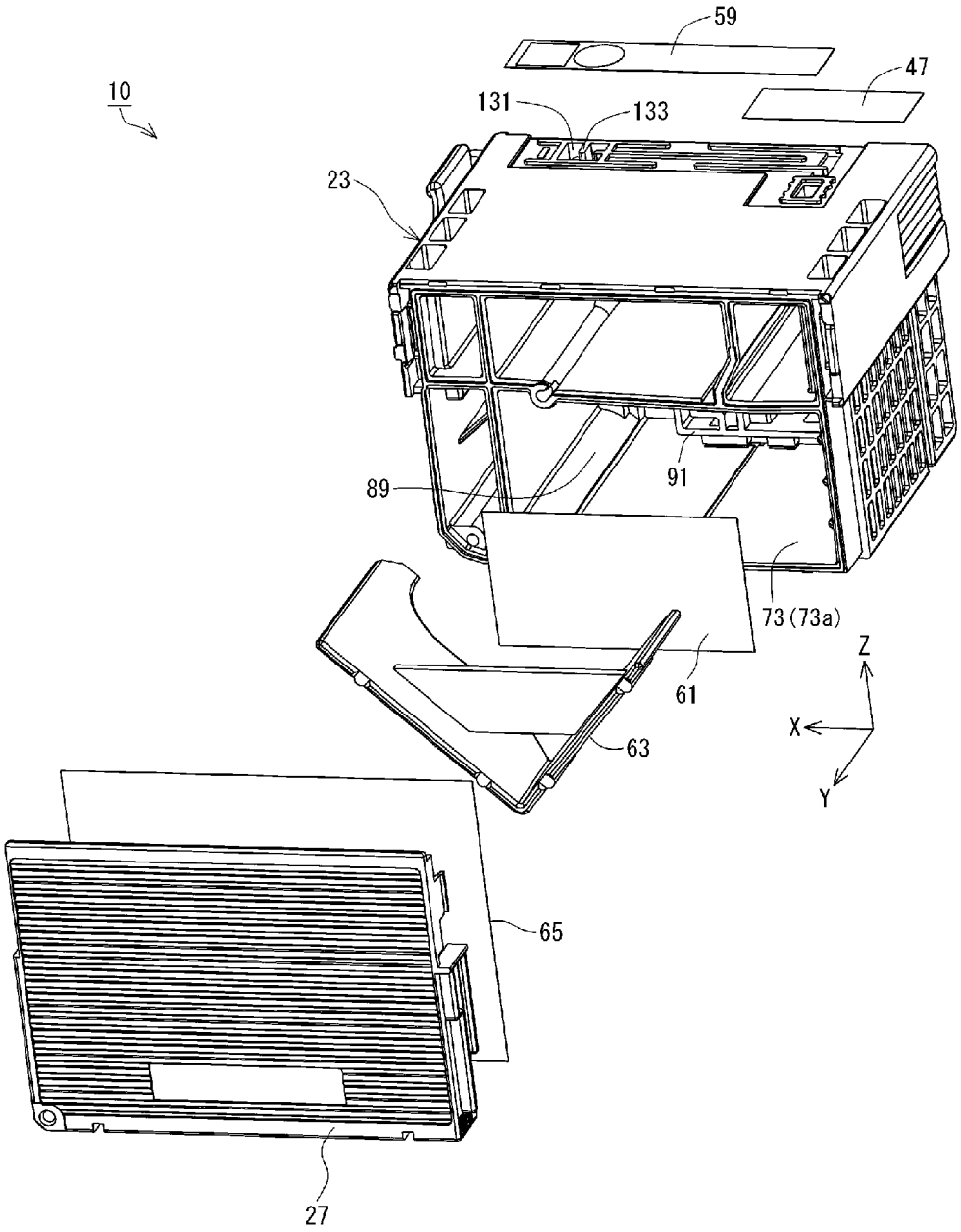
FIG. 4 is an exploded perspective view of the cartridge in this embodiment.

As shown in FIG. 3, in addition to the above-described constituent components, the cartridge 10 also includes a valve unit 51, a supply portion unit 53, a filter 55, and a film 57. As shown in FIG. 4, the cartridge 10 has a label 59, a film 61, a reinforcing member 63, and a film 65.

Figure 5A:
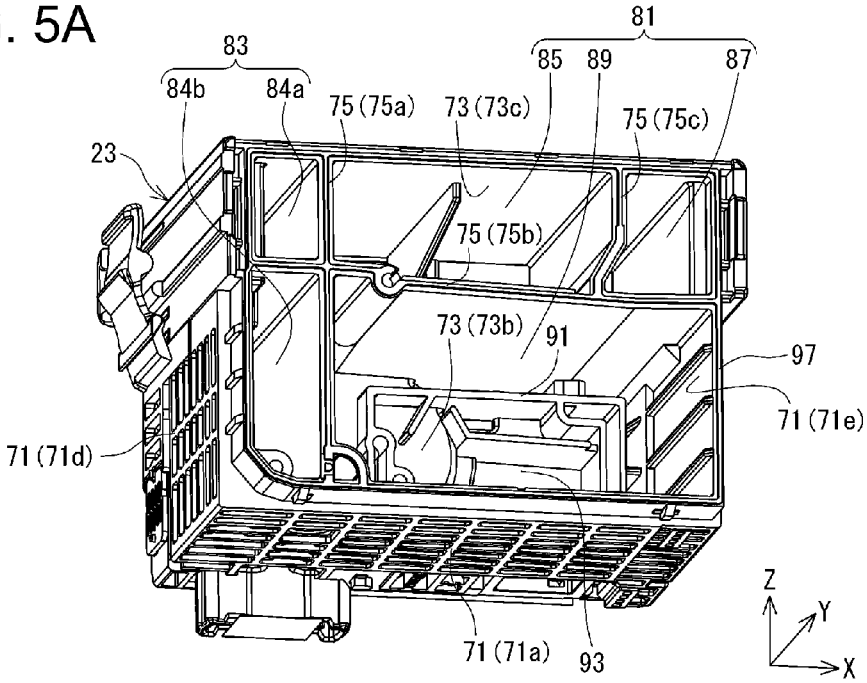
FIGS. 5A and 5B are perspective views showing the external appearance of a casing in this embodiment.

Hereinafter, the casing 23 will be described. The casing 23 has five walls 71 as shown in FIG. 5A, which is a first external perspective view of the casing 23 and FIG. 5B, which is a second external perspective view of the casing 23. The casing 23 is in the shape of a recessed box surrounded by the five walls 71. Hereinafter, when identifying each of the five walls 71, the five walls 71 are respectively referred to as a first wall 71*a*, a second wall 71*b*, a third wall 71*c*, a fourth wall 71*d*, and a fifth wall 71*e*. The first wall 71*a* forms part of the bottom face 11*a* of the cartridge 10. The film 21 is bonded onto the second wall 71*b*. The third wall 71*c* forms part of the top face 11*b* of the cartridge 10. The fourth wall 71*d* forms part of the front face 11*c* of the cartridge 10. The fifth wall 71*e* forms part of the rear face 11*d* of the cartridge 10.

The first wall 71*a* and the third wall 71*c* oppose each other, and are separated from each other, in the Z axis direction. The fourth wall 71*d* and the fifth wall 71*e* oppose each other, and are separated from each other, in the X axis direction. The second wall 71*b* intersects the first wall 71*a*, the third wall 71*c*, the fourth wall 71*d*, and the fifth wall 71*e*. Also, the first wall 71*a* intersects the fourth wall 71*d* and the fifth wall 71*e*. Also, the third wall 71*c* intersects the fourth wall 71*d* and the fifth wall 71*e*. Accordingly, the casing 23 is formed in the shape of a recessed box whose bottom corresponds to the second wall 71*b*. The back faces of the walls 71 form inner walls 73 of the casing 23, which is in the shape of a recessed box. The casing 23 has five inner walls 73 respectively corresponding to the five walls 71. Hereinafter, when identifying each of the five inner walls 73, the five inner walls 73 are respectively referred to as a first inner wall 73*a*, a second inner wall 73*b*, a third inner wall 73*c*, a fourth inner wall 73*d*, and a fifth inner wall 73*e*. The first inner wall 73*a* corresponds to the first wall 71*a*. In a similar manner, the second inner wall 73*b* corresponds to the second wall 71*b*, the third inner wall 73*c* corresponds to the third wall 71*c*, the fourth inner wall 73*d* corresponds to the fourth wall 71*d*, and the fifth inner wall 73*e* corresponds to the fifth wall 71*e*.

A plurality of partition plates 75 are provided inside the casing 23. The internal space of the casing 23 is partitioned by the plurality of partition plates 75 into a plurality of chambers. In this embodiment, three partition plates 75 are provided inside the casing 23, and the internal space of the casing 23 is partitioned by the three partition plates 75 into five chambers. Hereinafter, when identifying each of the three partition plates 75, the three partition plates 75 are respectively referred to as a first partition plate 75*a*, a second partition plate 75*b*, and a third partition plate 75*c*. The first partition plate 75*a* extends in the Z axis direction from the third inner wall 73*c* to the first inner wall 73*a* (the back face of the first wall 71*a*). The second partition plate 75*b* extends in the X axis direction from the fourth inner wall 73*d* (the back face of the fourth wall 71*d*) to the fifth inner wall 73*e*. The first partition plate 75*a* and the second partition plate 75*b* intersect each other. The third partition plate 75*c* is positioned between the first partition plate 75*a* and the fifth inner wall 73*e*, and is provided in the Z axis direction connecting the third inner wall 73*c* and the second partition plate 75*b*.

Of the five chambers partitioned by the three partition plates 75, three chambers sandwiched between the first partition plate 75*a* and the fifth inner wall 73*e* function as a container portion 81 that contains ink. Meanwhile, two chambers sandwiched between the first partition plate 75*a* and the fourth inner wall 73*d* (the back face of the fourth wall 71*d*) function as an atmospheric introduction portion 83 that introduces atmospheric air. The atmospheric introduction portion 83 includes a first atmospheric chamber 84*a* and a second atmospheric chamber 84*b*. The container portion 81 includes a first container chamber 85, a second container chamber 87, and a third container chamber 89. A bank 91 is provided inside the third container chamber 89. The bank 91 is provided in a loop shape on the second inner wall 73*b*, and projects from the second inner wall 73*b*. The region surrounded by the bank 91 is partitioned from the third container chamber 89 as a fourth container chamber 93. That is to say, the third container chamber 89 internally includes the fourth container chamber 93.

The end portions of the three partition plates 75 on the side opposite the second inner wall 73*b*, and the end portions of the four walls 71 excluding the second wall 71*b* on the side opposite the second inner wall 73*b*, all have the same height in the Y axis direction. The film 65 shown in FIG. 4 is bonded to the three partition plates 75 at end portions of partition plates 75 that are opposite from the second inner wall 73*b*, and to the four walls 71 (except the second wall 71*b*) at end portions of the walls 71 that are opposite from the second inner wall 73*b*. Accordingly, the five chambers partitioned by the three partition plates 75 are individually sealed. Note that, as shown in FIG. 5A, the casing 23 is provided with a bank 97 extending along the end portions of the three partition plates 75 opposite from the second inner wall 73*b*, and the end portions of the four walls 71 (except the second wall 71*b*) opposite from the second inner wall 73*b*. In this embodiment, the film 65 shown in FIG. 4 is welded to the bank 97.

Figure 6A:
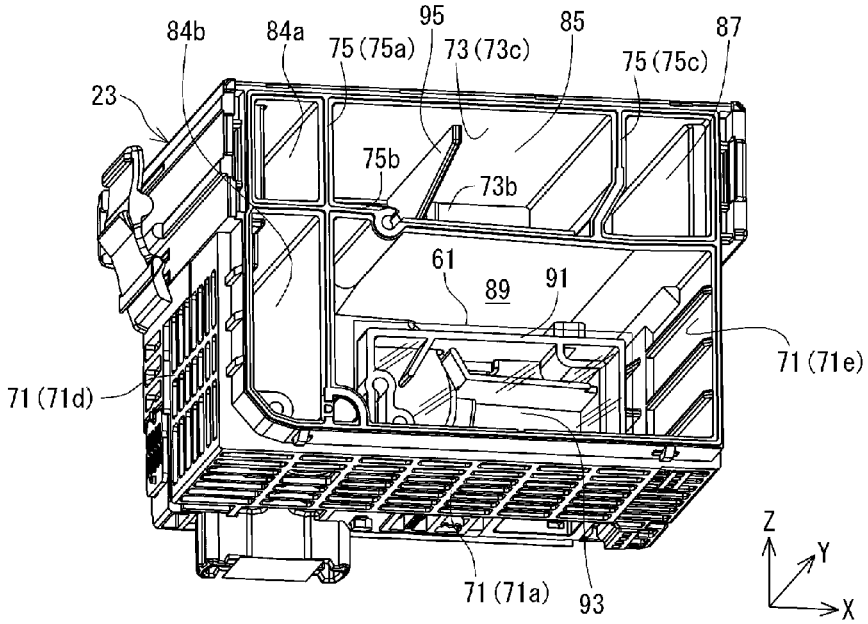
FIGS. 6A and 6B are perspective views showing the external appearance of the casing in this embodiment.
Figure 6B:
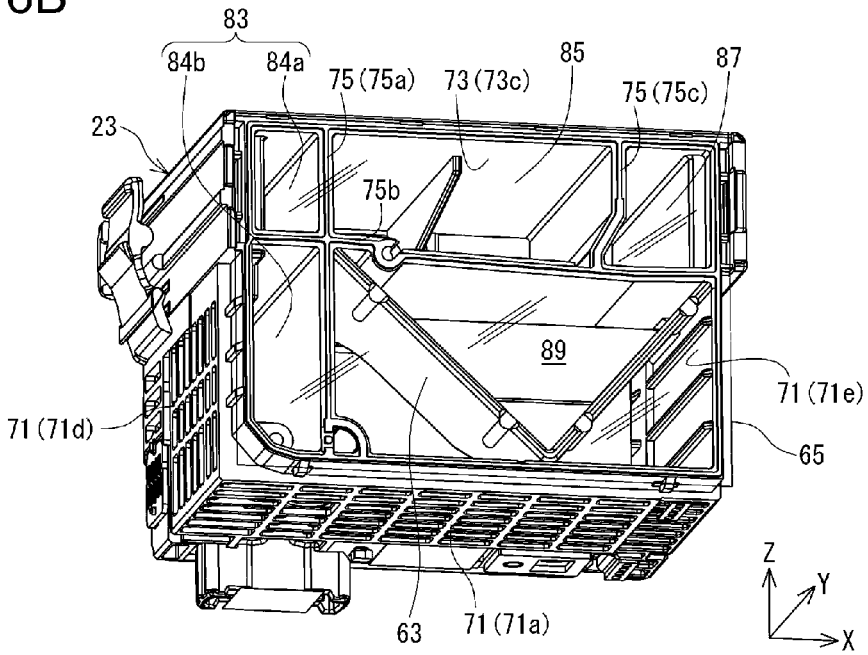

The end portion of the bank 91 on the side opposite from the second inner wall 73*b* is positioned closer to the second inner wall 73*b* than are any of the end portions of the three partition plates 75 on the side opposite from the second inner wall 73*b*. That is to say, the height in the Y axis direction of the bank 91 is lower than the height in the Y axis direction of each of the three partition plates 75. Thus, the fourth container chamber 93 surrounded by the bank 91 is included inside the third container chamber 89. As shown in FIG. 6B, which is a perspective view showing a state in which the film 61 has been bonded to the casing 23, the film 61 is bonded to the end portion of the bank 91 on the side opposite from the second inner wall 73*b*. Accordingly, the fourth container chamber 93 is partitioned from the third container chamber 89. A rib 95 is provided inside the first container chamber 85. The rib 95 is positioned between the first partition plate 75*a* and the third partition plate 75*c*, and intersects the second inner wall 73*b* and the third inner wall 73*c*. The thus configured casing 23 can be manufactured, for example, by molding a synthetic resin such as polyethylene, polystyrene, polypropylene, or the like.

Figure 5B:
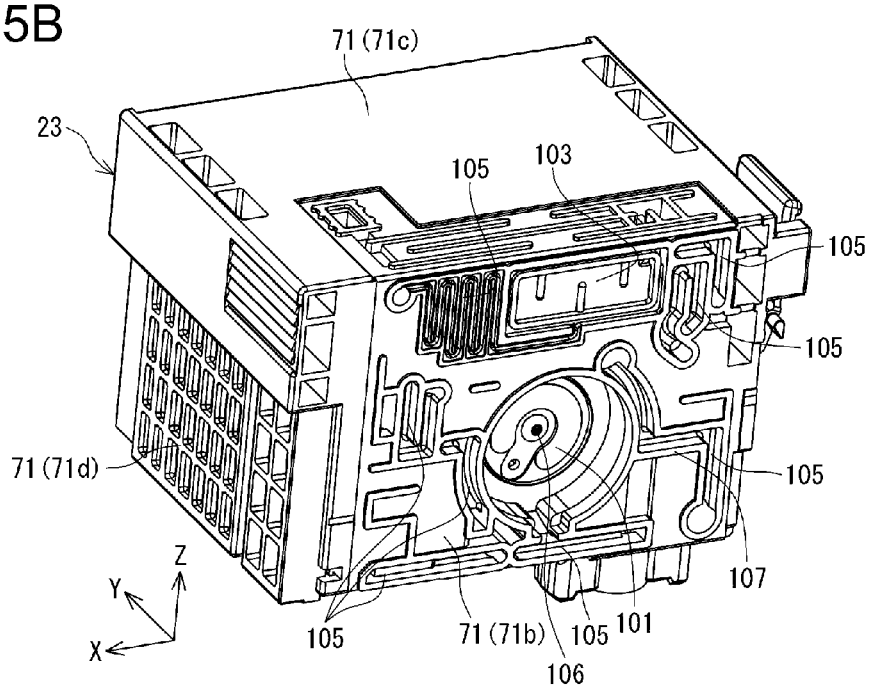

As shown in FIG. 5B, the second wall 71*b* is provided with a valve chamber 101, a separation chamber 103, and a plurality of grooves 105. A valve hole 106 is formed through the bottom portion of the valve chamber 101. The valve chamber 101, the separation chamber 103, and the plurality of grooves 105 are each in the shape of a recess that is recessed from the second wall 71*b* toward the second inner wall 73*b*. Each of the valve chamber 101, the separation chamber 103, and the plurality of grooves 105 forms part of a channel for atmospheric air or ink. The valve chamber 101, the separation chamber 103, and the plurality of grooves 105 are respectively surrounded by banks 107 that project from the second wall 71*b* toward the side opposite the second inner wall 73*b*. The film 21 shown in FIG. 3 is bonded onto the banks 107. Accordingly, the valve chamber 101, the separation chamber 103, and the plurality of grooves 105 are individually sealed.

As shown in FIG. 3, the valve unit 51 is accommodated in the valve chamber 101. The separation chamber 103 is covered by the filter 55 from the outside. In a state in which the valve unit 51 is accommodated in the valve chamber 101 and the separation chamber 103 is covered by the filter 55, the film 21 is bonded to the casing 23. Thus, the valve unit 51 is surrounded by the film 21 and the casing 23. The filter 55 is also surrounded by the film 21 and the casing 23. The filter 55 is made of a material through which gas, but not liquid, can pass through. When the film 21 is bonded onto the casing 23, each of the valve chamber 101, the separation chamber 103, and the plurality of grooves 105 functions as a channel for atmospheric air or ink.

The valve unit 51 includes a valve body 111, a spring 113, and a spring washer 115. The valve unit 51 opens and closes a channel by the valve body 111 deforming under a pressure difference in the channel between upstream and downstream of the valve body 111, in the direction of flow of fluid from the atmospheric opening port 45 to the supply opening 33. The spring 113 biases the valve body 111 in a direction that presses the valve body 111 against the valve hole 106. Operation of the valve body 111 adjusts the pressure on the side downstream of the valve chamber 101 (alternately referred to as a "valve downstream side") to be lower than the pressure on the side upstream from the valve chamber 101 (alternately referred to as a "valve upstream side"), so that the valve downstream side has a negative pressure with respect to atmospheric pressure as a reference. When the cartridge 10 is attached to the printer 1 and ink at the valve downstream side is consumed, the absolute value of the negative pressure at the valve downstream side increases, and the valve body 111 deforms away from the valve hole 106. At this time, ink inside the valve chamber 101 is supplied to the side downstream of the valve chamber 101, and the negative pressure on the valve downstream side returns to a predetermined range. As a result, the valve body 111 deforms under the force of the spring 113 to cover the valve hole 106. Also, atmospheric air (air) is introduced through the atmospheric opening port 45 into the container portion 81 as ink inside the container portion 81 is consumed.

The supply portion unit 53 is provided inside the supply portion 31. The supply portion unit 53 includes a seal member 117, a spring washer 119, and a spring 121. While the liquid supply needle of the printer 1 is in the supply portion 31, the seal member 117 seals any gaps between the inner wall of the supply portion 31 and the outer wall of the liquid supply needle. When the cartridge 10 is not mounted in the holder 3, the spring washer 119 is in contact with the seal member 117, and blocks the channel inside the supply portion 31. The spring 121 biases the spring washer 119 in a direction in which the spring washer 119 is brought into contact with the seal member 117. When the liquid supply needle is inserted into the supply portion 31, the liquid supply needle lifts the spring washer 119 in the positive direction of the Z axis, a gap is formed between the spring washer 119 and the seal member 117, and ink is supplied through this gap to the liquid supply needle.

As shown in FIG. 3, the first wall 71*a* of the casing 23 (the bottom face 11*a*) is provided with an opening portion 123 and a plurality of grooves 125. A prism portion 127 that is provided at the detection member 29 is inserted into the opening portion 123. The opening portion 123 with the prism portion 127 inserted therein is sealed by the detection member 29. The plurality of grooves 125 are each in the shape of a recess that is recessed in the direction from the first wall 71*a* toward the third inner wall 73*c* (FIG. 5A), that is, toward the internal space of the casing 23. Each of the plurality of grooves 125 forms part of a channel for atmospheric air or ink. The plurality of grooves 125 are respectively surrounded by banks 129 that project from the first wall 71*a* in the direction opposite from the internal space of the casing 23. The film 57 is bonded onto the banks 129. Accordingly, the plurality of grooves 125 are individually sealed. The cover 25 is attached to the casing 23 so as to cover the film 57. The cover 25 covers part of the first wall 71*a* of the casing 23, thereby also forming part of the bottom face 11*a*.

The prism portion 127 projects into the fourth container chamber 93, and functions as a detection member that the detecting device 15 of the printer 1 uses for optically detecting whether or not ink is present. The prism portion 127 is, for example, a light-transmissive member that is made of a synthetic resin such as polypropylene. The detection member 29 including the prism portion 127 may be made of a material that is not transparent, as long as it is light-transmissive to an appropriate extent. In situations where no optical detection is performed, the detection member 29 need not be light-transmissive. Furthermore, if no optical detection is performed, an opaque member or coating may be applied to the surface of the prism portion 127. Whether or not ink is present in the fourth container chamber 93 is detected, for example, as follows. The detecting device 15 that is provided at the printer 1 is provided with an optical sensor having a light-emitting element and a light-receiving element. The light-emitting element emits light toward the prism portion 127 of the detection member 29. When ink is present around the prism portion 127, light is transmitted through the prism portion 127, and enters the fourth container chamber 93. On the other hand, when ink is not present around the prism portion 127, light emitted from the light-emitting element is reflected from two reflecting faces of the prism portion 127, and impinges on the light-receiving element. The printer 1 determines whether or not ink is present in the fourth container chamber 93, based on whether or not light impinges on the light-receiving element.

As described above, the fourth container chamber 93 is provided inside the third container chamber 89. The volume of the fourth container chamber 93 is smaller than that of the third container chamber 89. The bottom area of the third container chamber 89 in directions that intersect the vertical direction is larger than that of the fourth container chamber 93. The prism portion 127 projects into the fourth container chamber 93, which has a volume smaller than that of the third container chamber 89. That is to say, this embodiment employs a configuration that detects the ink residual amount by detecting the amount of ink in the fourth container chamber 93 via the prism portion 127, which is provided inside the fourth container chamber 93.

Note that it is also possible to detect whether or not ink is present (detect the ink residual amount), using a configuration in which the fourth container chamber 93 is omitted, and the prism portion 127 is provided inside the third container chamber 89, for example. With this configuration, the ink residual amount is detected by detecting the amount of ink in the third container chamber 89. However, with this configuration, the detection precision in detecting the ink residual amount tends to be lower than that in the above-described embodiment. The reason for this is that, even though the height of the ink surface, which is used to detect the ink residual amount, varies by the same amount, the variation in the absolute amount of ink is greater when the area of the container portion is greater in directions that intersect the vertical direction.

In order to address this problem, this embodiment employs a configuration in which the fourth container chamber 93, which has a volume smaller than that of the third container chamber 89, is portioned inside the third container chamber 89, and the prism portion 127 is provided inside the fourth container chamber 93. Accordingly, even when the height of the ink surface, which is used to detect the ink residual amount, varies, the variation in the absolute amount of ink can be reduced. As a result, a decrease in the detection precision in detecting the ink residual amount can be avoided.

As described above, the film 61 shown in FIG. 4 is bonded onto the bank 91 inside the third container chamber 89. In this embodiment, the film 61 is welded to the bank 91. After the film 61 has been bonded onto the bank 91, the reinforcing member 63 is provided inside the third container chamber 89. As shown in FIG. 6B, which is a perspective view showing the reinforcing member 63 installed inside the casing 23, the reinforcing member 63 is fitted inside the third container chamber 89. The reinforcing member 63 reinforces the casing 23, and warping or deformation of the casing 23 can be reduced. Then, after the reinforcing member 63 has been fitted inside the third container chamber 89, the film 65 is bonded onto the casing 23. In this embodiment, the film 65 is welded across the end portions of the three partition plates 75 and the end portions of the four walls 71, except for the end portion of the second wall 71*b*.

As shown in FIG. 4, the cover 27 is disposed at the side of the film 65 that is opposite from the one facing the casing 23. The face of the cover 27 on the side opposite from the one facing the casing 23 forms the right face 11*e*. The cover 27 covers part of the first wall 71*a* of the casing 23, thereby also forming part of the bottom face 11*a*. Furthermore, the cover 27 covers part of the fourth wall 71*d* of the casing 23, thereby also forming part of the front face 11*c*. Furthermore, the cover 27 covers part of the fifth wall 71*e* of the casing 23, thereby also forming part of the rear face 11*d*.

As shown in FIG. 4, the third wall 71*c* (the top face 11*b*) of the casing 23 is provided with a groove 131. The groove 131 is in the shape of a recess that is recessed in the direction from the third wall 71*c* toward the first inner wall 73*a*, that is, toward the internal space of the casing 23. The groove 131 forms part of a channel for atmospheric air or ink. The groove 131 is surrounded by banks 133 that project from the third wall 71*c* toward the side opposite the internal space of the casing 23. The label 59 is bonded onto the banks 133. Accordingly, the groove 131 is sealed.

Figure 7:
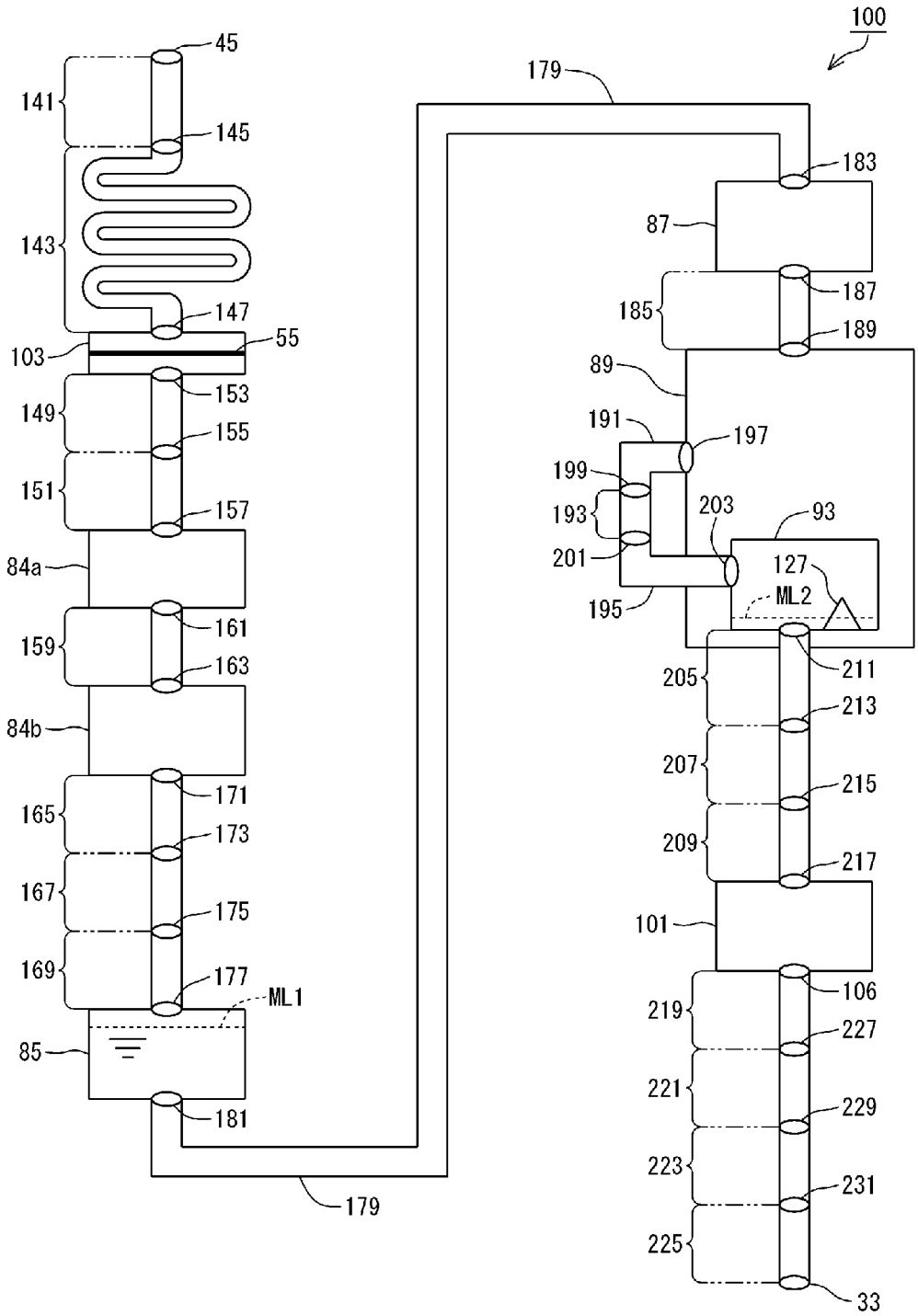
FIG. 7 is a diagram schematically showing a channel from an atmospheric exposure opening to a supply opening in this embodiment.

Hereinafter, the channel from the atmospheric opening port 45 to the supply opening 33 will be described. For facilitating understanding, first, the channel from the atmospheric opening port 45 to the supply opening 33 will be conceptually described. Note that direction of fluid flow from the atmospheric opening port 45 to the supply opening 33 is considered as a fluid flow direction. The terms "upstream" or "downstream" are used based on this fluid flow direction. As shown in FIG. 7, a channel 100 from the atmospheric opening port 45 to the supply opening 33 includes the separation chamber 103, the first atmospheric chamber 84*a*, the second atmospheric chamber 84*b*, the first container chamber 85, the second container chamber 87, the third container chamber 89, the fourth container chamber 93, and the valve chamber 101. The separation chamber 103 is provided downstream from the atmospheric opening port 45. The first atmospheric chamber 84*a* is provided downstream from the separation chamber 103. The second atmospheric chamber 84*b* is provided downstream from the first atmospheric chamber 84*a*. The first container chamber 85 is provided downstream from the second atmospheric chamber 84*b*. The second container chamber 87 is provided downstream from the first container chamber 85. The third container chamber 89 is provided downstream from the second container chamber 87. The fourth container chamber 93 is provided downstream from the third container chamber 89. The valve chamber 101 is provided downstream from the fourth container chamber 93.

The atmospheric opening port 45 and the separation chamber 103 are in communication with each other via a first internal channel 141 and a meandering channel 143. The first internal channel 141 is provided downstream of the atmospheric opening port 45. The atmospheric opening port 45 is in communication with the first internal channel 141. The meandering channel 143 is provided downstream from the first internal channel 141. The first internal channel 141 and the meandering channel 143 are in communication with each other through a communication opening 145. The meandering channel 143 and the separation chamber 103 are in communication with each other through a communication opening 147. The meandering channel 143 is configured to be long and meandering such that the length of the channel from the atmospheric opening port 45 to the first container chamber 85 is long. Accordingly, evaporation of liquid components of ink inside the container portion 81 can be suppressed. The filter 55 is disposed inside the separation chamber 103 so as to partition the channel. Even if ink flows backward from the first container chamber 85 upstream, the filter 55 can restrict flow of ink to the upstream side of the filter 55.

The separation chamber 103 and the first atmospheric chamber 84*a* are in communication with each other through an upper face channel 149 and a first surface channel 151. The upper face channel 149 is provided downstream from the separation chamber 103. The separation chamber 103 is in communication with the upper face channel 149 through a communication opening 153. The first surface channel 151 is provided downstream from the upper face channel 149. The upper face channel 149 and the first surface channel 151 are in communication with each other through a communication opening 155. The first surface channel 151 and the first atmospheric chamber 84*a* are in communication with each other through a communication opening 157.

The first atmospheric chamber 84*a* and the second atmospheric chamber 84*b* are in communication with each other through a second surface channel 159. The second surface channel 159 is provided downstream from the first atmospheric chamber 84*a*. The first atmospheric chamber 84*a* is in communication with the second surface channel 159 through a communication opening 161. The second surface channel 159 and the second atmospheric chamber 84*b* are in communication with each other through a communication opening 163.

If atmospheric air inside the container portion 81 expands due to a temperature increase or the like, and ink inside the container portion 81 flows backward to upstream from the first container chamber 85, the first atmospheric chamber 84*a* and the second atmospheric chamber 84*b* catch (trap) the backward flowing ink. Accordingly, the ink that flowed backward to upstream from the first container chamber 85 can be prevented from leaking from the atmospheric opening port 45. In this embodiment, of the plurality of atmospheric chambers, the second atmospheric chamber 84*b*, which is closer to the first container chamber 85 than the first atmospheric chamber 84*a*, has a volume larger than that of the first atmospheric chamber 84*a*. Accordingly, even if ink flows backward, the ink can be trapped further downstream (i.e., farther from the atmospheric opening port 45).

The second atmospheric chamber 84*b* and the first container chamber 85 are in communication with each other through a second internal channel 165, a third surface channel 167, and a third internal channel 169. The second internal channel 165 is provided downstream from the second atmospheric chamber 84*b*. The second atmospheric chamber 84*b* is in communication with the second internal channel 165 through a communication opening 171. The third surface channel 167 is provided downstream from the second internal channel 165. The second internal channel 165 and the third surface channel 167 are in communication with each other through a communication opening 173. The third internal channel 169 is provided downstream through the third surface channel 167. The third surface channel 167 and the third internal channel 169 are in communication with each other through a communication opening 175. The third internal channel 169 and the first container chamber 85 are in communication with each other through a communication opening 177.

In this embodiment, atmospheric air (air) that enters into the channel 100 through the atmospheric opening port 45 can flow to the first container chamber 85 and further downstream from the first container chamber 85, through the channel from the atmospheric opening port 45 to the third internal channel 169.

The first container chamber 85 and the second container chamber 87 are in communication with each other through a fourth surface channel 179. The fourth surface channel 179 is provided downstream from the first container chamber 85. The first container chamber 85 is in communication with the fourth surface channel 179 through a communication opening 181. The fourth surface channel 179 and the second container chamber 87 are in communication with each other through a communication opening 183.

The second container chamber 87 and the third container chamber 89 are in communication with each other through a fifth surface channel 185. The fifth surface channel 185 is provided downstream from the second container chamber 87. The second container chamber 87 is in communication with the fifth surface channel 185 through a communication opening 187. The fifth surface channel 185 and the third container chamber 89 are in communication with each other through a communication opening 189.

The third container chamber 89 and the fourth container chamber 93 are in communication with each other through a first lower face channel 191, a fourth internal channel 193, and a sixth surface channel 195. The first lower face channel 191 is provided downstream from the third container chamber 89. The third container chamber 89 is in communication with the first lower face channel 191 through a communication opening 197. The fourth internal channel 193 is provided downstream from the first lower face channel 191. The first lower face channel 191 and the fourth internal channel 193 are in communication with each other through a communication opening 199. The sixth surface channel 195 is provided downstream from the fourth internal channel 193. The fourth internal channel 193 and the sixth surface channel 195 are in communication with each other through a communication opening 201. The sixth surface channel 195 and the fourth container chamber 93 are in communication with each other through a communication opening 203.

The fourth container chamber 93 and the valve chamber 101 are in communication with each other through a seventh surface channel 205, a second lower face channel 207, and a first intra-casing channel 209. The seventh surface channel 205 is provided downstream from the fourth container chamber 93. The fourth container chamber 93 is in communication with the seventh surface channel 205 through a communication opening 211. The second lower face channel 207 is provided downstream from the seventh surface channel 205. The seventh surface channel 205 and the second lower face channel 207 are in communication with each other through a communication opening 213. The first intra-casing channel 209 is provided downstream from the second lower face channel 207. The second lower face channel 207 and the first intra-casing channel 209 are in communication with each other through a communication opening 215. The first intra-casing channel 209 and the valve chamber 101 are in communication with each other through a communication opening 217.

The valve chamber 101 and the supply opening 33 are in communication with each other through a second intra-casing channel 219, a third lower face channel 221, an eighth surface channel 223, and a supply path 225. The second intra-casing channel 219 is provided downstream from the valve chamber 101. The valve chamber 101 is in communication through the valve hole 106 with the second intra-casing channel 219. The third lower face channel 221 is provided downstream from the second intra-casing channel 219. The second intra-casing channel 219 and the third lower face channel 221 are in communication with each other through a communication opening 227. The eighth surface channel 223 is provided downstream from the third lower face channel 221. The third lower face channel 221 and the eighth surface channel 223 are in communication with each other through a communication opening 229. The supply path 225 is provided downstream from the eighth surface channel 223. The eighth surface channel 223 and the supply path 225 are in communication with each other through communication openings 231. Furthermore, the supply opening 33 is provided downstream from the supply path 225.

Next, the above-described channel 100 will be described with reference to the configuration of the casing 23.

Figure 8:
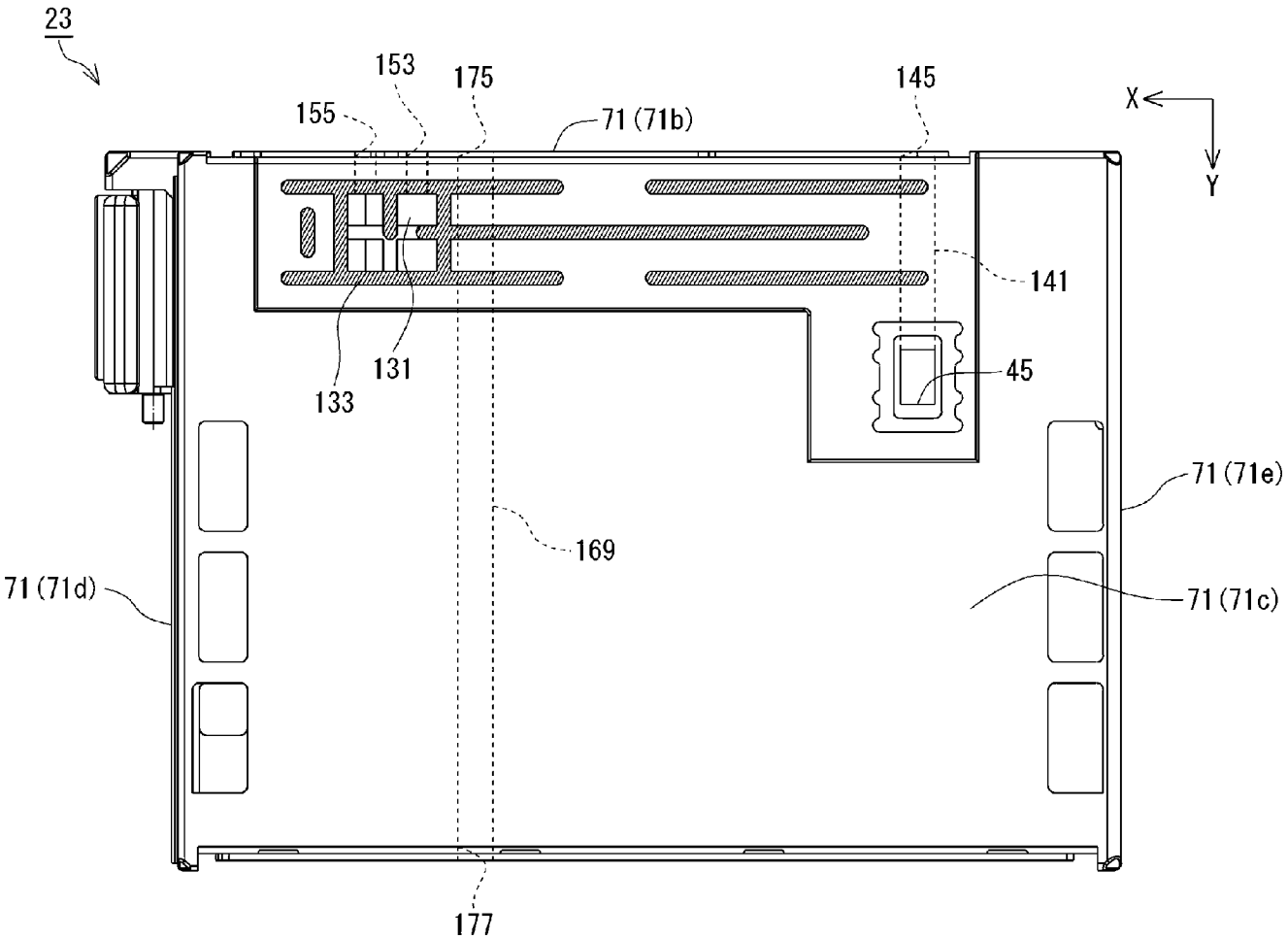
FIG. 8 is a plan view showing the casing in this embodiment.
Figure 9:
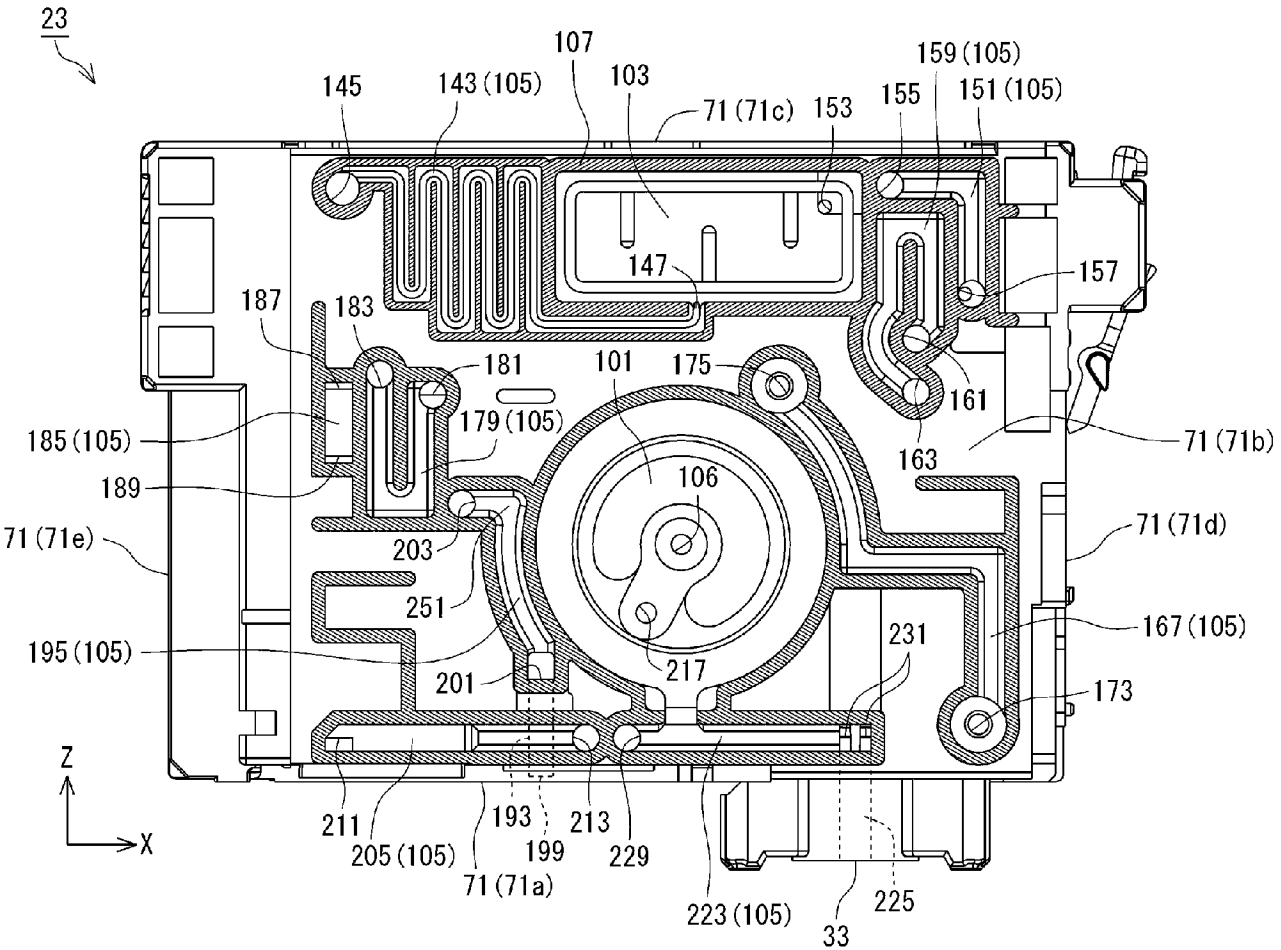
FIG. 9 is a side view showing the casing in this embodiment.

As shown in FIG. 8, the atmospheric opening port 45 is open in the third wall 71*c* of the casing 23. The first internal channel 141 extends in the Y axis direction through the casing 23, from the atmospheric opening port 45 to the communication opening 145. The first internal channel 141 starts from the atmospheric opening port 45, and extends from the third wall 71*c* to the second wall 71*b*. As shown in FIG. 9, the communication opening 145 is open in the second wall 71*b*. The first internal channel 141 extends from the third wall 71*c* to the communication opening 145.

The meandering channel 143 is provided in the second wall 71*b*, and is configured by the groove 105 that is connected to the communication opening 145. The meandering channel 143 is in communication with the separation chamber 103 through the communication opening 147. In FIG. 9, the banks 107 surrounding the grooves 105, the separation chamber 103, and the valve chamber 101 are hatched to facilitate understanding of the configuration. The separation chamber 103 is provided in the second wall 71*b*. The communication opening 153 is open inside the separation chamber 103. As shown in FIG. 8, the communication opening 153 that is open on the second wall 71*b* is in communication with the upper face channel 149. The upper face channel 149 is provided on the third wall 71*c*, and is configured by the groove 131 linked from the communication opening 153. In FIG. 8, the banks 133 surrounding the groove 131 are hatched to facilitate understanding of the configuration. The upper face channel 149 starts from the communication opening 153, and extends from the third wall 71*c* to the communication opening 155 of the second wall 71*b*.

Figure 10:
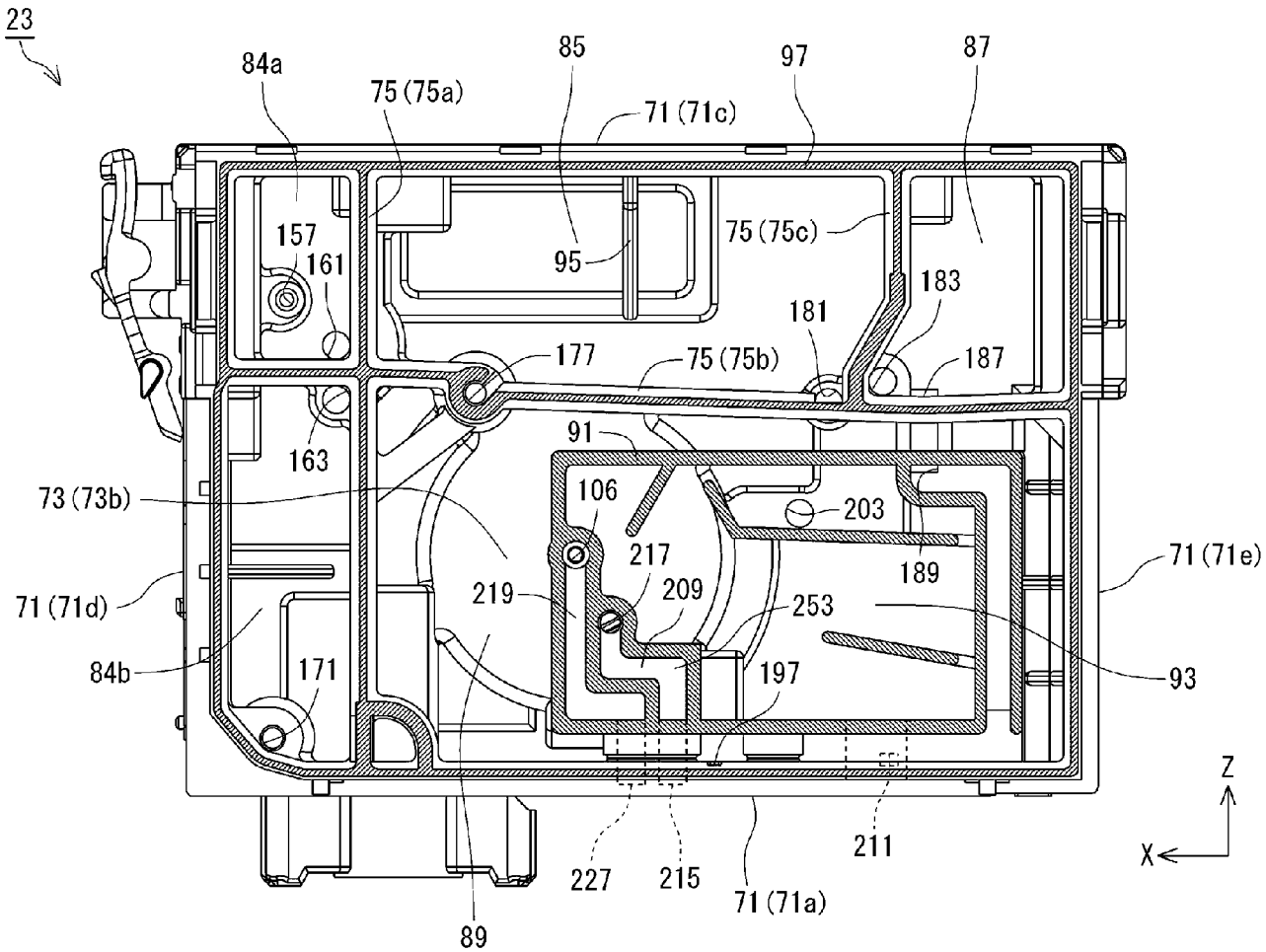
FIG. 10 is a side view showing the casing in this embodiment.

As shown in FIG. 9, the communication opening 155 is open in the second wall 71*b*. The groove 105 that is connected to the communication opening 155 is the first surface channel 151, and in communication with the communication opening 157. The communication opening 157 is open in the second wall 71*b*. As shown in FIG. 10, the communication opening 157 is in communication with the first atmospheric chamber 84*a*. In FIG. 10, the bank 97 is hatched to facilitate understanding of the configuration. The communication opening 161 opens into the first atmospheric chamber 84*a*. As shown in FIG. 9, the communication opening 161, which opens to the first atmospheric chamber 84*a*, is open in the second wall 71*b*. The groove 105 that is connected to the communication opening 161 is the second surface channel 159, and in communication with the communication opening 163. The communication opening 163 is opened in the second wall 71*b*. As shown in FIG. 10, the communication opening 163 is in communication with the second atmospheric chamber 84*b*.

Figure 11:
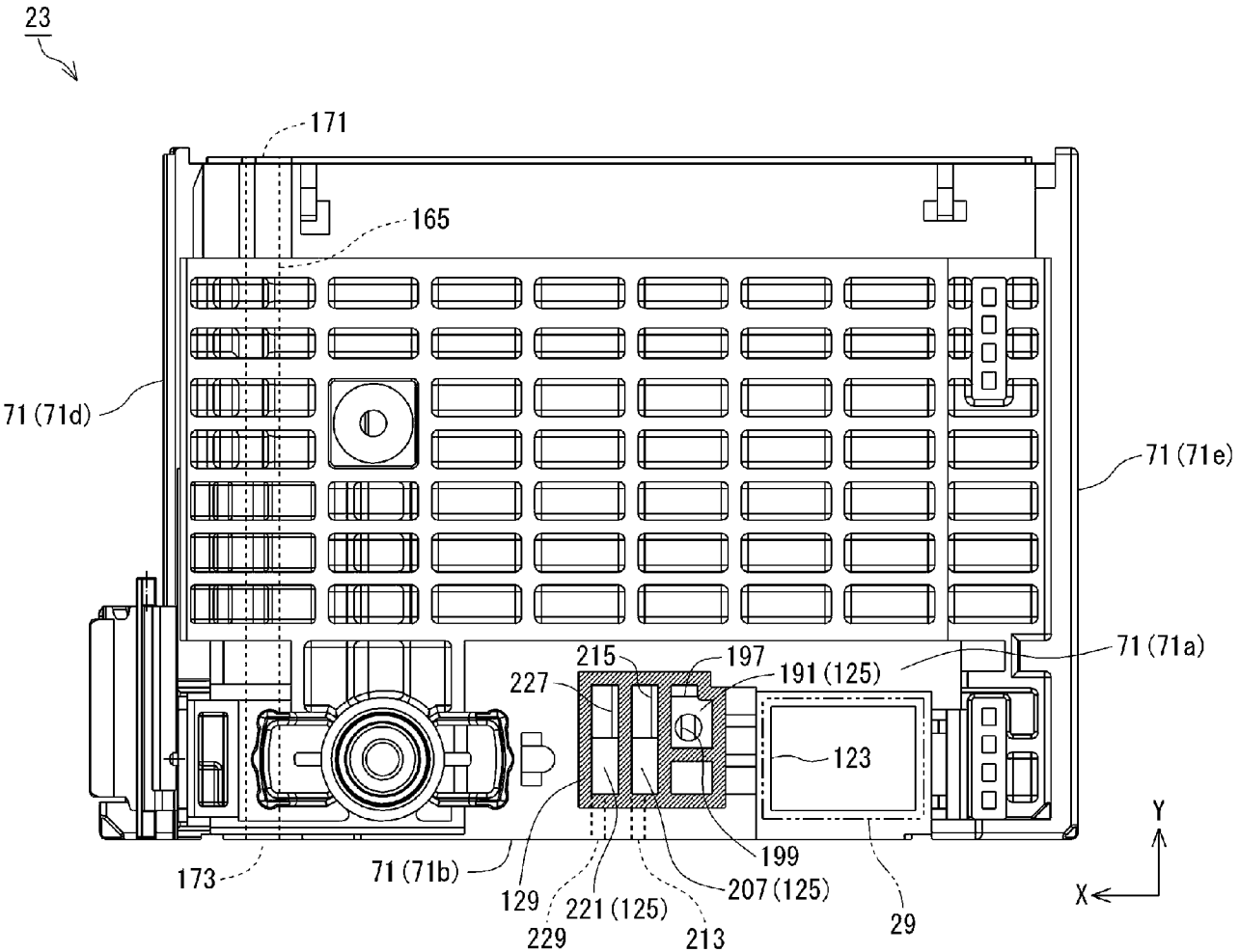
FIG. 11 is a bottom view showing the casing in this embodiment.

The communication opening 171 opens into the second atmospheric chamber 84*b*. As shown in FIG. 11, the communication opening 171, which opens into the second atmospheric chamber 84*b*, is in communication with the second internal channel 165. The second internal channel 165 extends in the Y axis direction through the casing 23. The second internal channel 165 starts from the communication opening 171, penetrates in the Y axis direction through the casing 23 to the second wall 71*b*. As shown in FIG. 9, the communication opening 173 is opened in the second wall 71*b*. The second internal channel 165 extends to the communication opening 173. The communication opening 173 is open on the second wall 71*b*. The groove 105 linked from the communication opening 173 is the third surface channel 167, and in communication with the communication opening 175. The communication opening 175 is opened in the second wall 71*b*. As shown in FIG. 8, the communication opening 175 is in communication with the third internal channel 169. The third internal channel 169 extends in the Y axis direction through the casing 23. The third internal channel 169 starts from the communication opening 175, penetrates in the Y axis direction through the casing 23 to the communication opening 177. As shown in FIG. 10, the communication opening 177 is in communication with the first container chamber 85.

The communication opening 181 opens into the first container chamber 85. As shown in FIG. 9, the communication opening 181, which opens into the first container chamber 85, is opened in the second wall 71*b*. The groove 105 that is connected to the communication opening 181 is the fourth surface channel 179, and in communication with the communication opening 183. The communication opening 183 is opened in the second wall 71*b*. As shown in FIG. 10, the communication opening 183 is in communication with the second container chamber 87.

The communication opening 187 opens into the second container chamber 87. As shown in FIG. 9, the communication opening 187, which opens into the second container chamber 87, is opened in the second wall 71*b*. The groove 105 that is connected to the communication opening 187 is the fifth surface channel 185, and in communication with the communication opening 189. The communication opening 189 is opened in the second wall 71*b*. As shown in FIG. 10, the communication opening 189 is in communication with the third container chamber 89.

The communication opening 197 opens into the third container chamber 89. As shown in FIG. 11, the communication opening 197, which opens into the third container chamber 89, is opened in the first wall 71*a*. The groove 125 that is connected to the communication opening 197 is the first lower face channel 191, and in communication with the communication opening 199. The communication opening 199 is opened in the first wall 71*a*. As shown in FIG. 9, the communication opening 199 is in communication with the fourth internal channel 193. The fourth internal channel 193 extends in the Z axis direction through the casing 23. The fourth internal channel 193 starts from the communication opening 199, and extends from the first wall 71*a* to the second wall 71*b*. The communication opening 201 is opened in the second wall 71*b*. The fourth internal channel 193 extends from the first wall 71*a* to the communication opening 201.

The groove 105 that is connected to the communication opening 201 is the sixth surface channel 195, and in communication with the communication opening 203. The communication opening 203 is opened in the second wall 71*b*. As shown in FIG. 10, the communication opening 203 is in communication with the fourth container chamber 93. The communication opening 211 opened into the fourth container chamber 93. As shown in FIG. 9, the communication opening 211, which opens into the fourth container chamber 93, is opened in the second wall 71*b*. The groove 105 that is connected to the communication opening 211 is the seventh surface channel 205, and in communication with the communication opening 213. As shown in FIG. 11, the communication opening 213 is in communication with the communication opening 215 through the second lower face channel 207, which is configured by one of the grooves 125. The communication opening 215 is opened in the first wall 71*a*. As shown in FIG. 10, the communication opening 215 is in communication with the first intra-casing channel 209. The first intra-casing channel 209 is in communication with the communication opening 217.

As shown in FIG. 9, the communication opening 217 is opened in the second wall 71*b* at a position inside the valve chamber 101. The valve hole 106 opens into the valve chamber 101. As shown in FIG. 10, the valve hole 106, which opens into the valve chamber 101, is opened in the second inner wall 73*b*, and is in communication with the second intra-casing channel 219. The second intra-casing channel 219 is in communication with the communication opening 227. As shown in FIG. 11, the communication opening 227 is opened in the first wall 71*a*. The communication opening 227 is in communication with the communication opening 229 through the third lower face channel 221, which is configured by one of the grooves 125. As shown in FIG. 9, the communication opening 229 is opened in the second wall 71*b*. The groove 105 linked from the communication opening 229 is the eighth surface channel 223, and in communication with the communication openings 231. The communication openings 231 are opened in the second wall 71*b*. The communication openings 231 are in communication with the supply path 225. The supply path 225 extends in the Z axis direction through the casing 23, and is in communication with the supply opening 33.

When the cartridge 10 is manufactured, it is filled with ink to, for example, a liquid level ML1, which is a level of a liquid surface indicated by the broken line in FIG. 7. In this embodiment, the liquid level ML1 is set inside the first container chamber 85. As ink inside the cartridge 10 is consumed by the printer 1, the liquid level moves downstream, and in place of this, atmospheric air flows into the cartridge 10 from upstream through the atmospheric opening port 45. Then, as the consumption of ink progresses, the liquid level drops to a liquid level ML2 inside the fourth container chamber 93. At this time, the prism portion 127 protrudes above the liquid level ML2. Accordingly, the control unit 9 detects, using the detecting device 15, that little or no ink remains in the cartridge 10. Then, before ink inside the cartridge 10 is completely used up, the control unit 9 stops printing and notifies the user that the ink is about used up. Thus, a situation in which the print head is driven when there is no ink can be avoided. If the print head is driven when there is no ink, air may become mixed in with ink in the print head, which may lead to a malfunction. In this embodiment, such a situation can be avoided.

Method of Manufacturing the Cartridge

Hereinafter, a method of manufacturing the cartridge 10 will be described. In this embodiment, a method of manufacturing the cartridge 10 will be described wherein a cartridge 10 in which ink has been consumed until the ink residual amount reached a predetermined value or less, is again filled with ink (refill processing). Note that the method of manufacturing the cartridge 10 described below can be used also as a method of manufacturing the cartridge 10 by filling ink into an as yet unfilled, unused cartridge 10.

Figure 12:
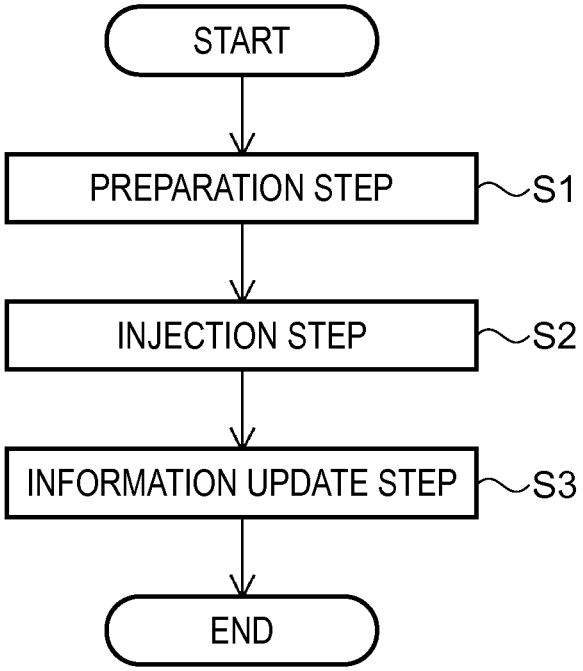
FIG. 12 is a flowchart showing the flow of a cartridge manufacturing method in this embodiment.

As shown in FIG. 12, the method of manufacturing the cartridge 10 in this embodiment includes a preparation step S1 that prepares the above-described cartridge 10, an injection step S2 that injects ink such that the ink is contained in the container portion 81, and an information update step S3. Note that, in this embodiment, as the ink injecting method in the injection step S2, a method is employed in which ink is injected from the side upstream from the fourth container chamber 93, in the channel 100 from the atmospheric opening port 45 to the supply opening 33.

The information update step S3 is a step of rewriting the information about ink consumption amount stored in the memory provided on the circuit board 40 of the cartridge 10, into a value indicating a sufficient amount of ink for printing. When ink is used until the residual amount of ink in the cartridge 10 reaches a predetermined value or less, information indicating a residual amount of ink that is at or below the predetermined value may be stored in the memory. In this case, even after the cartridge is refilled, the printer 1 may determine the cartridge 10 is empty, and may not commence normal printing operations. In this embodiment, in the information update step S3, the ink consumption amount information in the memory is updated to a value indicating an amount of ink that enables printing, that is, indicating that ink is contained in an amount that is more than the predetermined value. Accordingly, when the cartridge 10 is attached to the printer 1, the printer 1 commences normal printing operations. Note that the step S3 may be omitted.

Figure 13:
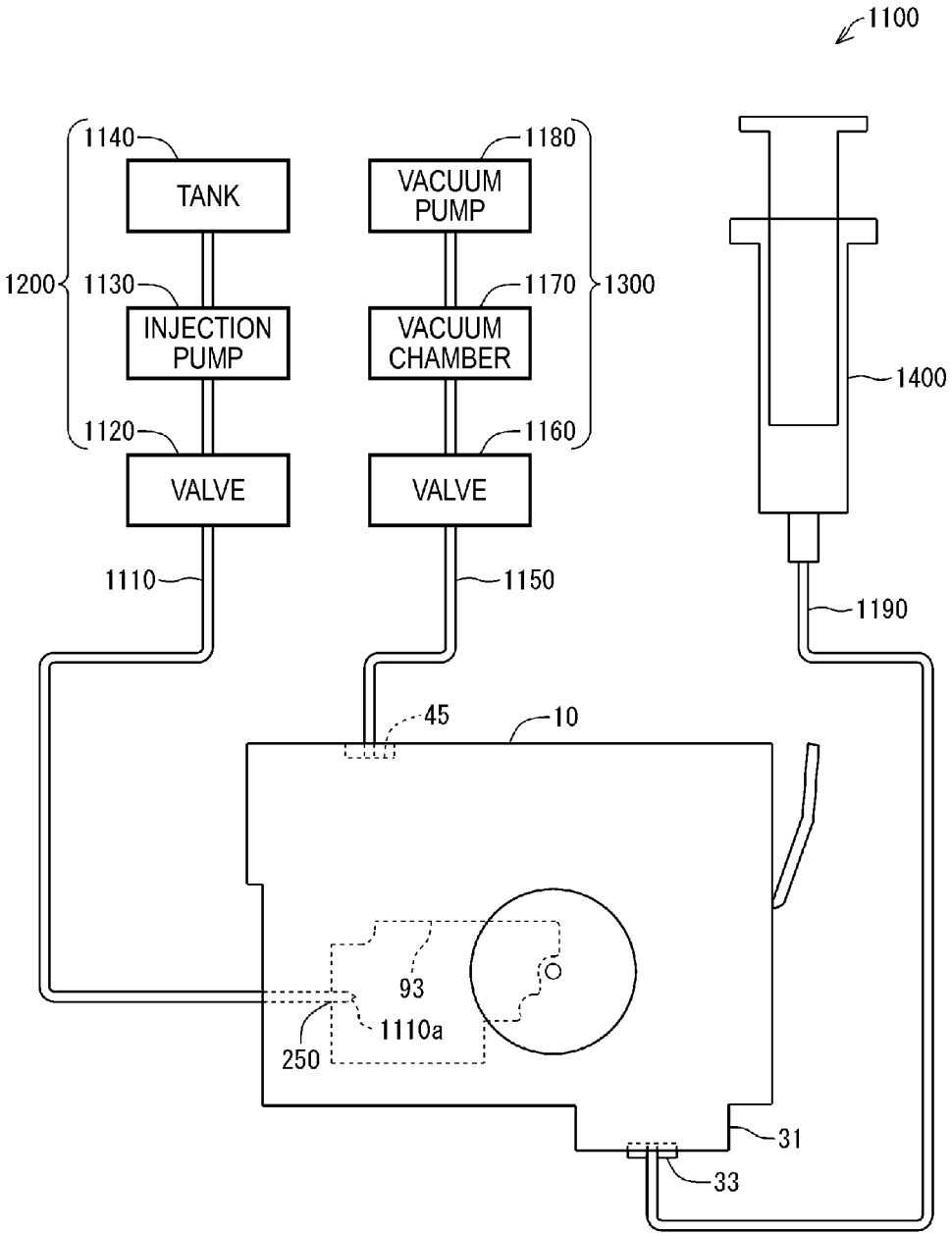
FIG. 13 is a diagram showing the schematic configuration of an injection system in this embodiment.

When injecting ink in the injection step S2, for example, an injection system 1100 shown in FIG. 13 may be used. The injection system 1100 includes an injection apparatus 1200, a vacuum apparatus 1300, and a suction apparatus 1400. The injection apparatus 1200 is provided with a tube 1110, a valve 1120, an injection pump 1130, and a tank 1140. The valve 1120 is disposed upstream from the tube 1110. The injection pump 1130 is disposed upstream from the valve 1120. The tank 1140 is disposed upstream from the injection pump 1130. For example, a needle-tipped tube may be used as the tube 1110. A front end portion 1110*a* of the tube 1110 is open, and ink can flow out from the front end portion 1110*a*. FIG. 13 schematically shows a state in which ink is injected starting at the fourth container chamber 93. The vacuum apparatus 1300 is provided with a tube 1150, a valve 1160, a vacuum chamber 1170, and a vacuum pump 1180. The valve 1160 is disposed upstream from the tube 1150. The vacuum chamber 1170 is disposed upstream from the valve 1160. The vacuum pump 1180 is disposed upstream from the vacuum chamber 1170. For example, a needle-tipped tube may be used as the tube 1150. The suction apparatus 1400 is syringe-like and provided with a tube 1190. The tube 1190 has a needle-like tip, which lifts the spring washer 119 when inserted into the supply opening 33.

Figure 14:
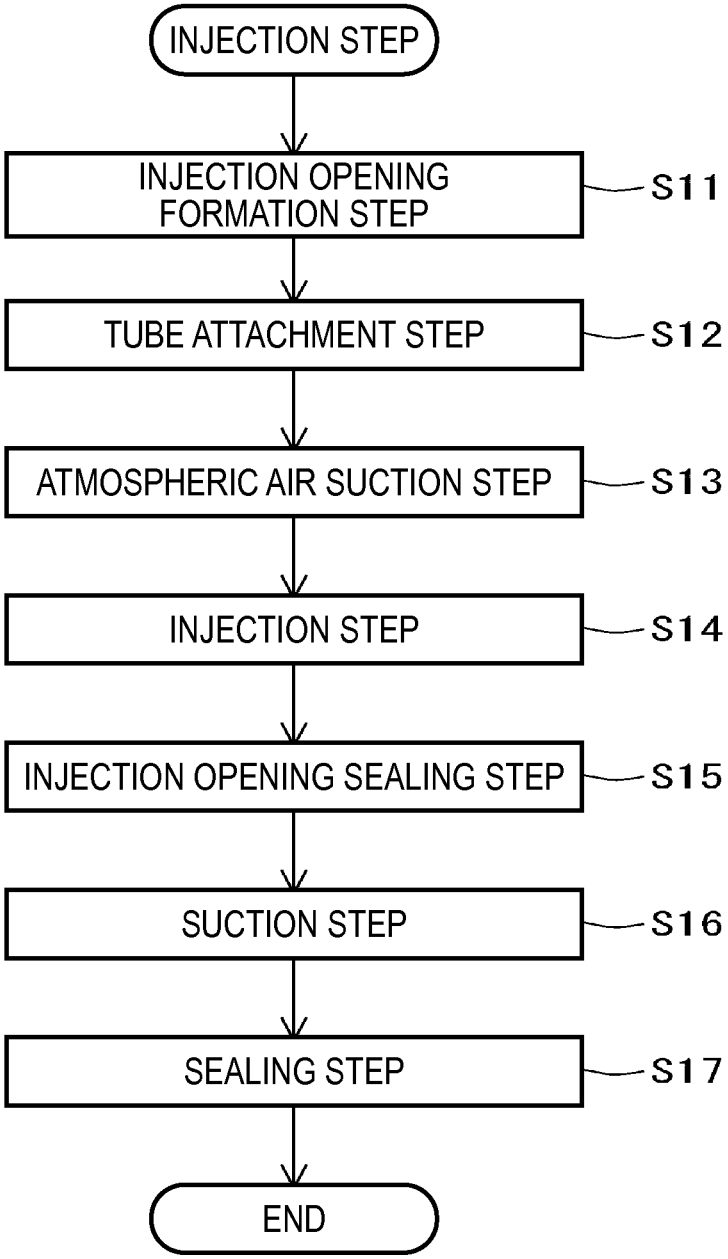
FIG. 14 is a flowchart showing the flow of an injection step in this embodiment.

As shown in FIG. 14, the injection step S2 includes an injection opening formation step S11, a tube attachment step S12, an atmospheric air suction step S13, an injection step S14, an injection opening sealing step S15, a suction step S16, and a sealing step S17. In the injection opening formation step S11, an injection opening 250 through which ink is to be injected into the cartridge 10 is formed through the cartridge 10. The injection opening 250 is formed by opening a hole through the wall forming the channel 100 of the cartridge 10, at a position that is in or downstream from the fourth container chamber 93, and that is also upstream from the valve hole 106. The injection opening 250 may be provided in a wall forming a predetermined portion into which ink is to be directly injected. For example, when injecting ink starting at the fourth container chamber 93 (FIG. 10), the injection opening 250 may be formed by opening a hole through a wall that forms the fourth container chamber 93. Note that one of the walls forming the fourth container chamber 93 is the film 61 (FIG. 6A). Another wall that forms the fourth container chamber 93 is the second wall 71*b* (FIG. 5B). The injection opening 250 can be formed, for example, by opening a hole through a wall using a drill. Alternatively, the injection opening 250 can be formed, for example, by opening a hole through a wall by piercing the tube 1110 into the wall.

As described above, the injection opening 250 can be formed by opening a hole through a wall that forms the channel 100. Once the injection opening 250 is formed, ink can be injected into the cartridge 10 through the injection opening 250. The injection opening 250 can be easily formed by opening a hole through, of the walls that form the channel 100, the film 21, the film 57, the film 61, the label 59, and the like.

In the tube attachment step S12, the tube 1110 is attached to the injection opening 250. Note that, if the tube 1110 is used to pierce the wall, the injection opening formation step S11 and the tube attachment step S12 are simultaneously performed.

In the atmospheric air suction step S13, the vacuum apparatus 1300 attached to the atmospheric opening port 45 sucks atmospheric air from inside the cartridge 10 through the atmospheric opening port 45. At this time, first the valve 1160 (FIG. 13) is closed, then the vacuum pump 1180 operated until the pressure inside the vacuum chamber 1170 is sufficiently reduced. Then, the valve 1160 is opened up, whereupon atmospheric air inside the cartridge 10 is sucked through the atmospheric opening port 45. Accordingly, the pressure inside the channel 100 of the cartridge 10 is reduced. Note that the vacuum apparatus 1300 can be attached to the atmospheric opening port 45 at any time as long as it is before start of the atmospheric air suction step S13.

In the injection step S14 shown in FIG. 14, ink is injected from the injection opening 250 of the cartridge 10 into the cartridge 10. In the injection step S14, while the suction of atmospheric air from the atmospheric opening port 45 (FIG. 13) continues, the injection pump 1130 is driven, and the valve 1120 is opened. Accordingly, ink inside the tank 1140 is injected through the injection opening 250 of the cartridge 10. Once a predetermined amount of ink fills the container portion 81, drive of the injection apparatus 1200 is stopped. Accordingly, injection of ink is stopped. At this time, drive of the vacuum apparatus 1300 is also stopped. Then the injection apparatus 1200 and the vacuum apparatus 1300 are detached from the cartridge 10.

In the injection opening sealing step S15, the injection opening 250 is sealed. The injection opening 250 can be sealed, for example, with a film, an elastic member such as rubber and the like. Accordingly, the possibility that ink contained inside the cartridge 10 flows through the injection opening 250 to the outside can be reduced.

In the suction step S16, the suction apparatus 1400 shown in FIG. 13 is driven. The valve unit 51 closes while the contents of the cartridge 10 are being sucked through the atmospheric opening port 45 by the vacuum apparatus 1300. Thus, ink is not introduced downstream from the valve unit 51. Accordingly, in the suction step S16 shown in FIG. 14, atmospheric air inside the channel 100 is sucked through the supply opening 33. By this, the valve unit 51 opens, so that ink is introduced from upstream of the valve unit 51 to the downstream side.

In the sealing step S17, the atmospheric opening port 45 is sealed with the film 47, and the supply opening 33 is sealed with the film 35. Accordingly, the injection step S2 ends.

The cartridge 10 can be manufactured using this procedure. This embodiment employs a method in which ink is injected into the container portion 81 through the injection opening 250, which is formed in the channel 100 at a position that is in or downstream from the fourth container chamber 93, and that is also upstream from the valve hole 106. According to this method, the injected ink is easily introduced into the fourth container chamber 93. As a result, a decrease in the precision in detecting the amount of ink can be more readily avoided. Note that, in this embodiment, ink is injected into the container portion 81 from the injection opening 250 formed at the fourth container chamber 93, which is where the detection member 29 is provided, and, thus, ink can be directly injected into the fourth container chamber 93. Thus, the injected ink is easily introduced into the fourth container chamber 93. Accordingly, a decrease in the precision in detecting the amount of ink can be more readily avoided.

Furthermore, the location at which the injection opening 250 is formed is not limited to the fourth container chamber 93. The injection opening 250 may be formed, for example, through the film 21 at a location in which the film 21 overlaps the communication opening 203. The communication opening 203 is opened in the second wall 71*b*. Furthermore, the communication opening 203 also opens into the fourth container chamber 93. Thus, if the injection opening 250 is formed through the film 21 at a location in which the film 21 overlaps the communication opening 203, ink can be directly injected into the fourth container chamber 93.

Furthermore, the injection opening 250 may be formed, for example, at the detection member 29. The detection member 29 covers, from the outside of the casing 23, the opening portion 123 opened in the casing 23. Thus, if the injection opening 250 is formed at the detection member 29, the injection opening 250 opens into the internal space of the fourth container chamber 93. Thus, ink can be directly injected into the fourth container chamber 93 through the injection opening 250 formed at the detection member 29.

As a method of forming the injection opening 250, for example, a method may be employed in which the opening portion 123 opened in the casing 23 is used as the injection opening 250. According to this method, the detection member 29 is detached from the casing 23 and the opening portion 123 is exposed, and, thus, the opening portion 123 is used as the injection opening 250. Thus, ink can be directly injected into the fourth container chamber 93 through the opening portion 123 functioning as the injection opening 250.

The injection opening 250 may be formed, for example, between the fourth container chamber 93 and the valve chamber 101. In this case, ink can be injected from a channel downstream from the fourth container chamber 93, and, thus, the ink flows through the channel downstream from the fourth container chamber 93 and reaches the fourth container chamber 93. If air bubbles are mixed in with the injected ink, the air bubbles are more readily caught in the channel while the ink is flowing through the channel. Accordingly, air mixing in of bubbles in the fourth container chamber 93 can be more readily avoided. As a result, clinging of air bubbles to the detection member 29 can be more readily suppressed, and, thus, it is easier to avoid a decrease in the precision in detecting the amount of ink.

The injection opening 250 may be formed, for example, at the seventh surface channel 205. The seventh surface channel 205 is positioned downstream from the fourth container chamber 93. Ink can be injected from a channel downstream from the fourth container chamber 93, and, thus, the ink flows through the channel downstream from the fourth container chamber 93 and reaches the fourth container chamber 93. If air bubbles are mixed in with the injected ink, the air bubbles are more readily caught in the channel while the ink is flowing through the channel. Accordingly, mixing in of air bubbles in the fourth container chamber 93 can be more readily avoided. As a result, clinging of air bubbles to the detection member 29 can be more readily suppressed, and, thus, it is easier to avoid a decrease in the precision in detecting the amount of ink.

If the injection opening 250 is formed at the seventh surface channel 205, and a method is employed in which the injection opening 250 is formed through the film 21, then formation of the injection opening 250 through the casing 23 can be avoided.

The injection opening 250 may be formed, for example, at the second lower face channel 207. In this case, a method may be employed in which the injection opening 250 is formed through the film 57. In this embodiment, the film 57 is light-transmissive. If ink is injected from the second lower face channel 207 through an injection opening 250 formed through the film 57, the state of the ink being injected can be seen through the detection member 29 when the ink is injected.

Furthermore, the injection opening 250 may be formed, for example, at the first intra-casing channel 209. As shown in FIG. 10, the first intra-casing channel 209 is provided with a bent portion 253. The bent portion 253 is positioned between the communication opening 215 and the communication opening 217. In the first intra-casing channel 209, part of the channel between the communication opening 217 and the bent portion 253 overlaps the valve body 111 in plan view. In this embodiment, the injection opening 250 is formed at a location in which the channel between the communication opening 217 and the bent portion 253 overlaps the valve body 111. Accordingly, ink injected from the injection opening 250 flows through the bent portion 253, and then the communication opening 215 into the fourth container chamber 93. At that time, if air bubbles are mixed in with the injected ink, the air bubbles are more readily caught in the bent portion 253 while the ink is flowing through the channel. Accordingly, it is easier to avoid air bubbles mixing into the fourth container chamber 93.

Note that, in this embodiment, the optical member having the prism portion 127 is used as the detection member 29. However, the detection member 29 is not limited thereto, and various members may be used as long as they are members used to detect the ink residual state in the cartridge 10. As the detection member 29, for example, a piezoelectric element and the like also may be used.

In the foregoing embodiment, the film 61 corresponds to a first sheet member, the film 57 corresponds to a second sheet member, and the film 21 corresponds to a third sheet member. Furthermore, the first wall 71*a* corresponds to a first outer wall, and the second wall 71*b* corresponds to a second outer wall. Furthermore, the sixth surface channel 195 corresponds to a first outer wall channel, the seventh surface channel 205 corresponds to a second outer wall channel, the second lower face channel 207 corresponds to a third outer wall channel, and the bent portion 253 corresponds to a bent portion.

As described above, according to this embodiment, mixing of air bubbles in the fourth container chamber 93 at the time of ink injection can be more readily avoided. If air bubbles are mixed in with the ink in the fourth container chamber 93, the air bubbles in the fourth container chamber 93 may reach the print head. If the air bubbles reach the print head, the ink ejection performance of the print head may be lowered. That is to say, if air bubbles are mixed in with the ink in the fourth container chamber 93, a problem occurs in which the ink ejection performance may be lowered.

If ink is injected into the container portion 81 into or downstream from the fourth container chamber 93, air bubbles are more likely to mix in the ink downstream from the fourth container chamber 93. However, the supply opening 33 is provided downstream from the fourth container chamber 93. Thus, for example, when the cartridge 10 is attached to the printer 1, air bubbles mixed in with the ink downstream from the fourth container chamber 93 can be more readily discharged from the supply opening 33 in an initial stage, by the ink suction operation and the like.

On the other hand, if ink is injected into the container portion 81 from the side upstream from the fourth container chamber 93, air bubbles are more likely to mix in with ink upstream from the fourth container chamber 93. Air bubbles that have mixed in the ink upstream from the fourth container chamber 93 cannot be easily discharged in an initial stage. Thus, air bubbles that have been mixed in the ink upstream from the fourth container chamber 93 may flow through the fourth container chamber 93 and reach the print head during printing. Accordingly, it is preferable that ink is injected into the container portion 81 from the fourth container chamber 93 or the side downstream from the fourth container chamber 93 also for the purpose of avoiding air bubbles reaching the print head during printing.

The fourth container chamber 93 is partitioned off by the film 61 inside the third container chamber 89. That is to say, the film 61 is disposed inside the third container chamber 89. Thus, if the injection opening 250 is formed upstream from the fourth container chamber 93, the possibility that the film 61 will be damaged increases. This possibility increases particularly when ink is injected from the film 65 side. It is difficult to repair the damaged film 61. Thus, also in order to avoid damage to the film 61, it is preferable that ink is injected into the container portion 81 from the fourth container chamber 93 or downstream from the fourth container chamber 93.

Figure 15:
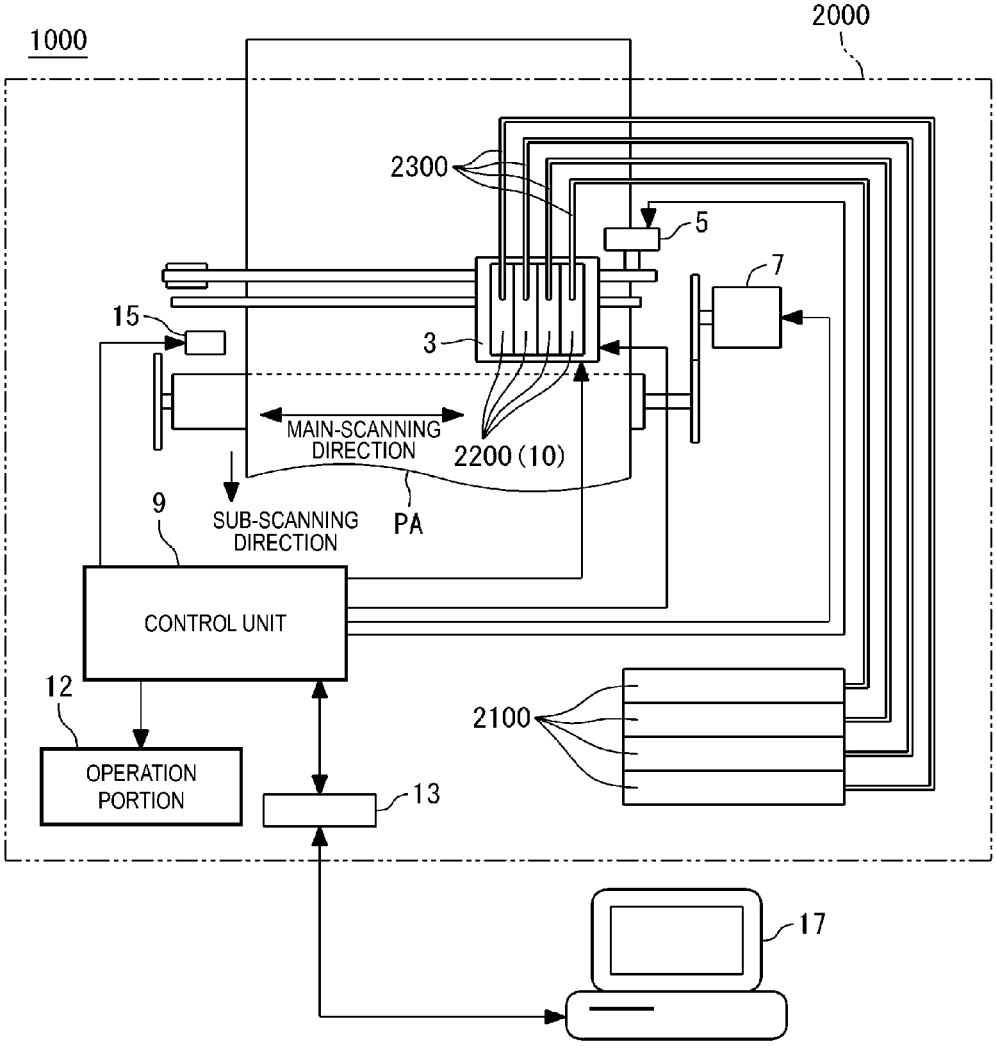
FIG. 15 is a diagram showing another exemplary printer in this embodiment.

In the printer 1 in this embodiment, when little or no ink remains in the cartridge 10, the cartridge is replaced by a new cartridge 10 having a sufficient residual amount. However, the mode of the printer 1 is not limited to this. The printer 1 may be embodied in another mode in which ink is supplied to the print head from tanks having an ink capacity larger than that of the cartridges 10. As shown in FIG. 15, a printer 2000 embodied in such a mode is provided with tanks 2100 and relay units 2200. The tanks 2100 store ink. The ink inside the tanks 2100 is supplied through tubes 2300 to the relay units 2200. The relay units 2200 are attached to the holder 3. The relay units 2200 are detachably mounted in the holder 3. In the printer 2000, the above-described cartridges 10 are used as the relay units 2200.

Ink in the tanks 2100 is supplied through the tubes 2300 to the relay units 2200. The ink supplied to the relay units 2200 is further supplied to the print head (not shown) that is provided at the holder 3. That is to say, the relay units 2200 have a function of relaying ink inside the tanks 2100 to the print head. Then, when little or no ink remains in the tanks 2100, a user can refill the tanks 2100 with ink. The tanks 2100 are provided with injection openings (not shown). The user can refill the tanks 2100 with ink through these injection openings.

Figure 16A:
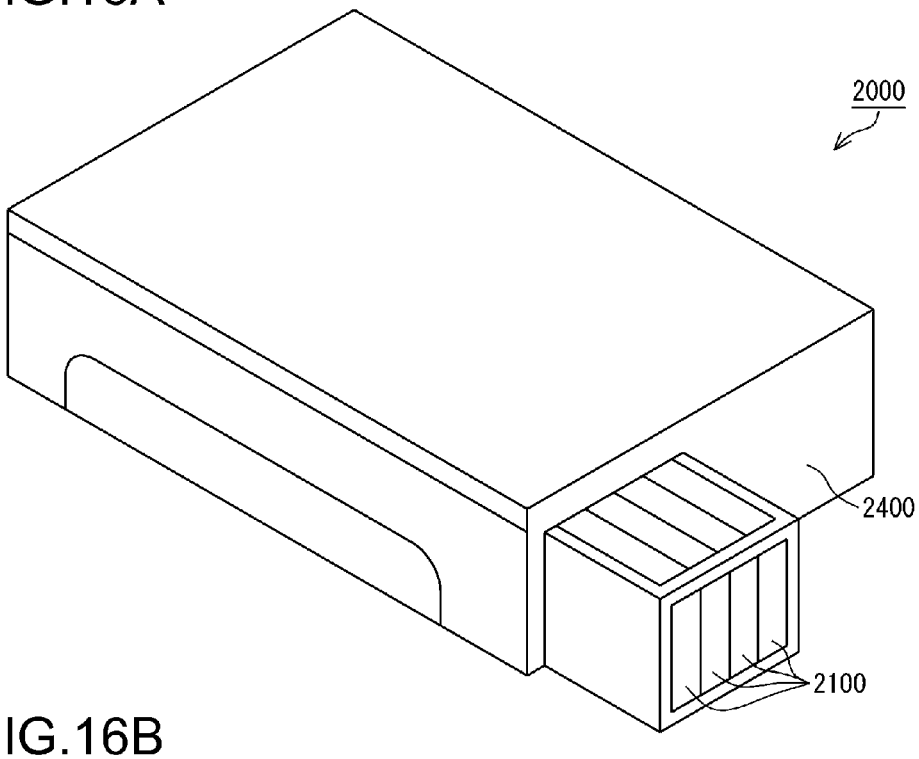
FIGS. 16A and 16B are perspective views showing the external appearance of the exemplary printer in this embodiment.
Figure 16B:
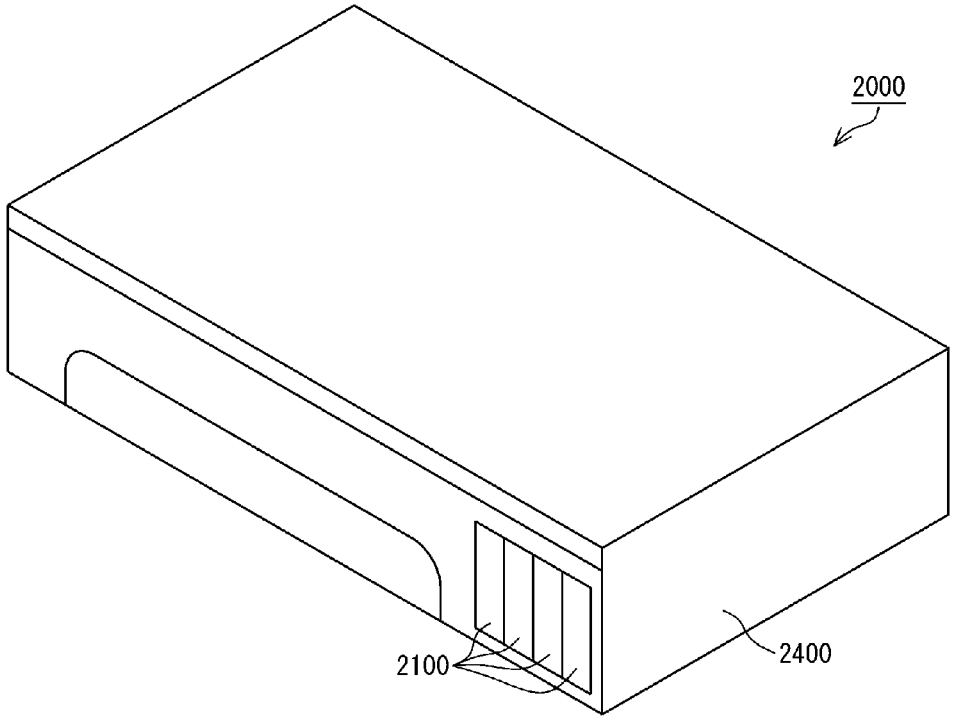

Note that a mode of the printer 2000 may be such that, as shown in FIG. 16A, the tanks 2100 are installed on the outer side of an external casing (housing) 2400 of the printer 1. The mode in which the tanks 2100 are installed on the outer side of the external casing 2400 is referred to as an external installation mode of the tanks 2100. Another mode of the printer 2000 may be such that, as shown in FIG. 16B, the tanks 2100 are installed internally to the external casing 2400 of the printer 1. The mode in which the tanks 2100 are installed internally in the external casing 2400 is referred to as an internal installation mode of the tanks 2100.

Figure 17:
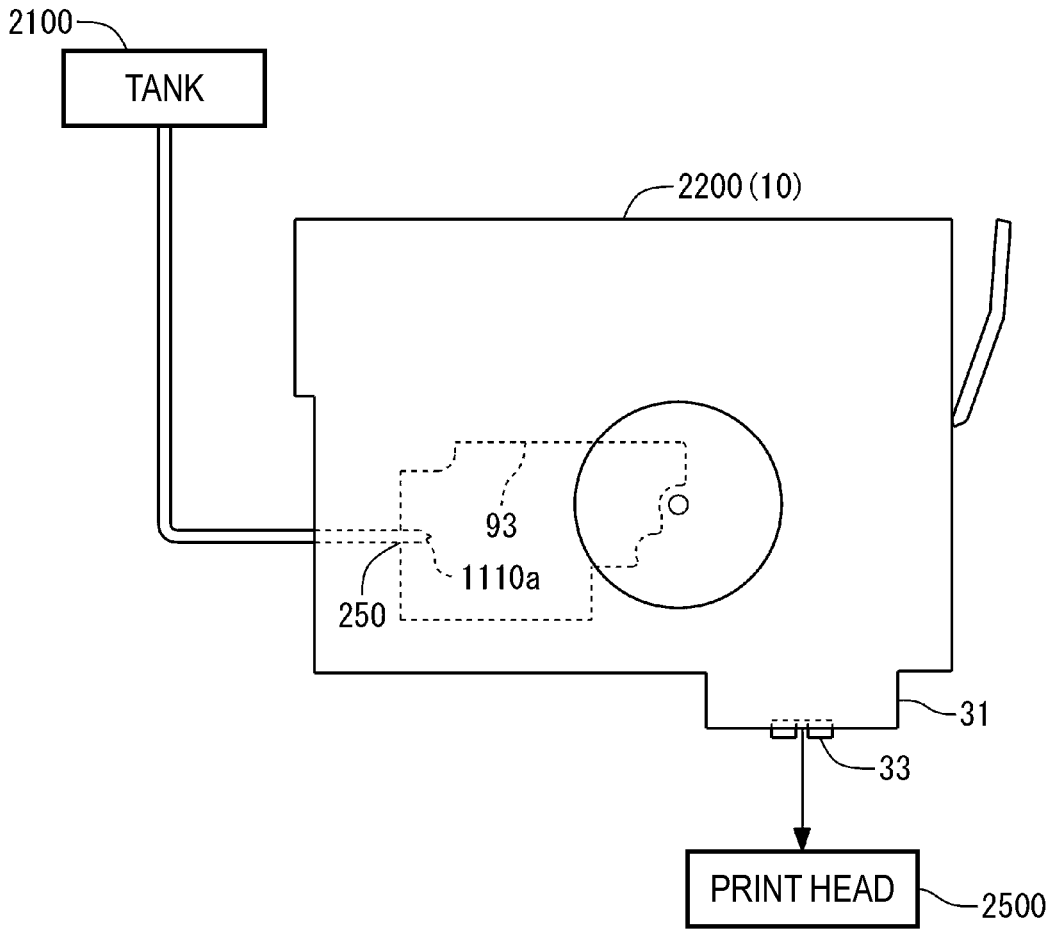
FIG. 17 is a diagram illustrating the flow of ink in the exemplary printer in this embodiment.

As shown in FIG. 17, ink inside the tank 2100 is supplied through the tube 2300 and the injection opening 250 into the container portion 81 of the cartridge 10, which functions as the relay unit 2200. The ink supplied to the container portion 81 is further supplied through the supply opening 33 to a print head 2500. Also in the printer 2000, the injection opening 250 of the cartridge 10 is formed at or downstream from the fourth container chamber 93. Accordingly, the printer 2000 can also achieve similar effects as those for the printer 1. The injection opening 250 of the cartridge 10 may be formed at the above-described various locations as long as they are at or downstream from the fourth container chamber 93.

The invention can be applied not only to ink-jet printers and ink cartridges thereof, but also to any liquid-jet apparatuses that consume liquid other than ink, and liquid containers that are used for these liquid-jet apparatuses. For example, the invention can be applied to liquid containers that are used for the various liquid-jet apparatuses described below:

(1) image recording apparatuses such as facsimile apparatuses, (2) coloring material-jet apparatuses used to manufacture color filters for image displays, such as liquid crystal displays, (3) electrode material-jet apparatuses used to form electrodes for organic electro luminescence (EL) displays, field emission displays (FEDs), or the like, (4) liquid-jet apparatuses that form a jet of liquid including bioorganic materials used to manufacture biochips, (5) sample-jet apparatuses used as precision pipettes, (6) lubricating oil-jet apparatuses, (7) resin liquid-jet apparatuses, (8) liquid-jet apparatuses that form a jet of lubricating oil for pinpoint application onto precision machines such as watches or cameras, (9) liquid-jet apparatuses that form a jet of transparent resin liquid such as ultraviolet curing resin liquid onto a substrate in order to form minute hemispherical lenses (optical lenses) used for optical communications devices or the like, (10) liquid-jet apparatuses that form a jet of acidic or alkaline etching liquid in order to perform etching on a substrate or the like, and (11) liquid-jet apparatuses that include a liquid consumption head for ejecting a slight amount of any other droplet.

Note that the "droplet" refers to a state of liquid that is ejected from a liquid-jet apparatus, and examples thereof include a spherical shape, a tear shape, and a shape having a thread-like trailing end. Furthermore, the "liquid" in this case may be any material that can be used in a liquid-jet apparatus. For example, the "liquid" may be any material that is in a liquid phase, and examples thereof also include materials in a liquid state having high or low viscosity, sol, gel water, and other materials in a liquid state such as inorganic solvent, organic solvent, solution, liquid resin, liquid metal (metallic melt), and the like. Furthermore, examples of the "liquid" include not only liquid, as one state of materials, but also materials in which are dissolved, dispersed, or mixed in solvent, particles of functional material made of a solid, such as pigments or metal particles. This sort of "liquid" also may be referred to as a "liquid state material". Typical examples of the liquid or the liquid state material include ink, liquid crystal, and the like as described in the foregoing embodiments. Incidentally, it is assumed that examples of the ink include various liquid state compositions such as commonly used water-based ink, oil-based ink, gel ink, and hot melt ink.

What is claimed is:

1. A method of manufacturing a liquid container, the liquid container including:

a casing provided with a container portion for containing liquid, a supply opening through which the liquid inside the container portion is supplied outside of the liquid container, and a detection member for detecting an amount of the liquid in the container portion, wherein the container portion is partitioned into:

a first container chamber for containing the liquid, a second container chamber that is provided downstream from the first container chamber with respect to a flow of the liquid from the container portion toward the supply opening, and that is in communication with the first container chamber, a third container chamber that is provided downstream from the second container chamber and that is in communication with the second container chamber, and a fourth container chamber that is provided downstream from the third container chamber and that is in communication with the third container chamber, the fourth container chamber being provided inside the third container chamber and being partitioned by a first sheet member from the third container chamber, the detection member being provided inside the fourth container chamber, the method comprising:

forming, in the liquid container, an injection opening in communication with the container portion at the fourth container chamber or downstream from the fourth container chamber; and injecting liquid into the injection opening.

2. The method of manufacturing a liquid container according to claim 1, wherein the method comprising:

forming the injection opening at the fourth container chamber.

3. The method of manufacturing a liquid container according to claim 2, wherein the casing includes a channel from the third container chamber to the fourth container chamber, the channel includes a first outer wall channel provided on a second outer wall of the casing, and the first outer wall channel is sealed by a third sheet member from the outside of the casing, wherein the method comprising:

forming the injection opening in the third sheet member from the second outer wall side through a region in which the third sheet member overlaps a communication opening that opens from the first outer wall channel into the fourth container chamber.

4. The method of manufacturing a liquid container according to claim 1, wherein a first outer wall of the casing is provided with an opening portion that opens from the outside of the casing into the fourth container chamber, and the detection member is light-transmissive, covers the opening portion from the outside of the casing, and projects from the opening portion into the fourth container chamber, the method comprising:

forming the injection opening at the detection member.

5. The method of manufacturing a liquid container according to claim 1, wherein a first outer wall of the casing is provided with an opening portion that opens from the outside of the casing into the fourth container chamber, and the detection member is light-transmissive, covers the opening portion from the outside of the casing, and projects from the opening portion into the fourth container chamber, the method comprising:

forming the injection opening by detaching the detection member from the casing, thereby exposing the opening portion, and injecting the liquid through the opening portion, functioning as the injection opening.

6. The method of manufacturing a liquid container according to claim 1, wherein the casing includes a valve that is provided between the fourth container chamber and the supply opening, that allows the liquid to flow from the fourth container chamber toward the supply opening, and that blocks flow of the liquid from the supply opening toward the fourth container chamber, the method comprising:

forming the injection opening at a channel extending from the fourth container chamber to the valve.

7. The method of manufacturing a liquid container according to claim 6, wherein the channel from the fourth container chamber to the valve includes a second outer wall channel provided in a second outer wall of the casing, and the second outer wall channel is sealed by a third sheet member from the outside of the casing, the method including:

forming the injection opening through the third sheet member in the second outer wall channel.

8. The method of manufacturing a liquid container according to claim 1, wherein a first outer wall of the casing is provided with an opening portion that opens from the outside of the casing into the fourth container chamber, the detection member is light-transmissive, projects from the opening portion into the fourth container chamber, and covers the opening portion from the outside of the casing, the channel from the fourth container chamber to the valve includes a third outer wall channel that is provided on the first outer wall of the casing, and the third outer wall channel is sealed from the outside of the casing by a second sheet member that is light-transmissive, the method including:

forming the injection opening through the second sheet member in the third outer wall channel.

9. The method of manufacturing a liquid container according to claim 6, wherein the channel from the fourth container chamber to the valve is provided with a bent portion, and at least part of a channel from the bent portion to the valve overlaps the valve, the method including:

forming the injection opening at a location in which the channel from the bent portion to the valve overlaps the valve.

10. A liquid container manufactured using the manufacturing method according to claim 1.

11. A liquid container manufactured using the manufacturing method according to claim 2.

12. A liquid container manufactured using the manufacturing method according to claim 3.

13. A liquid container manufactured using the manufacturing method according to claim 4.

14. A liquid container manufactured using the manufacturing method according to claim 5.

15. A liquid container manufactured using the manufacturing method according to claim 6.

16. A liquid container manufactured using the manufacturing method according to claim 7.

17. A liquid container manufactured using the manufacturing method according to claim 8.

18. A liquid container manufactured using the manufacturing method according to claim 9.

* * * * *